US011414898B2

(12) United States Patent
Okuyama et al.

(10) Patent No.: US 11,414,898 B2
(45) Date of Patent: Aug. 16, 2022

(54) AUTOMOBILE DOOR LATCH DEVICE

(71) Applicant: MITSUI KINZOKU ACT CORPORATION, Kanagawa (JP)

(72) Inventors: Keiichiro Okuyama, Kanagawa (JP); Toshitaka Matsuoka, Kanagawa (JP); Naoki Hanaki, Kanagawa (JP); Shigenori Hiramoto, Kanagawa (JP); Shintaro Okawa, Kanagawa (JP)

(73) Assignee: MITSUI KINZOKU ACT CORPORATION, Kanagawa (JP)

( * ) Notice: Subject to any disclaimer, the term of this patent is extended or adjusted under 35 U.S.C. 154(b) by 192 days.

(21) Appl. No.: 16/776,366

(22) Filed: Jan. 29, 2020

(65) Prior Publication Data

US 2020/0248486 A1 Aug. 6, 2020

(30) Foreign Application Priority Data

Feb. 4, 2019 (JP) ..... JP2019-017591

(51) Int. Cl.
*E05B 77/26* (2014.01)
*E05B 83/40* (2014.01)
(Continued)

(52) U.S. Cl.
CPC ..... *E05B 77/265* (2013.01); *E05B 79/04* (2013.01); *E05B 79/08* (2013.01); *E05B 79/16* (2013.01); *E05B 81/20* (2013.01); *E05B 83/40* (2013.01)

(58) Field of Classification Search
CPC ..... E05B 77/265; E05B 79/04; E05B 79/08; E05B 79/16; E05B 81/20; E05B 83/40
See application file for complete search history.

(56) References Cited

U.S. PATENT DOCUMENTS 8,616,594 B2 * 12/2013 Shimura ..... E05B 83/36 292/336.3
2002/0060461 A1 5/2002 Choi
(Continued)

FOREIGN PATENT DOCUMENTS

CN 1353054 A 6/2002
CN 103967358 A 8/2014
(Continued)

OTHER PUBLICATIONS

Chinese Office Action issued in corresponding Chinese Patent Application No. 202010078614. 7, dated Dec. 28, 2020, with English translation.

*Primary Examiner* — Kristina R Fulton
*Assistant Examiner* — James E Ignaczewski
(74) *Attorney, Agent, or Firm* — McDermott Will & Emery LLP

(57) ABSTRACT

An automobile door latch device includes: a mesh mechanism; a body; a base; and an operation mechanism disposed on the base, the operation mechanism including: an outside lever configured to receive an operating force of an outside handle to perform open actuation; a first open lever configured to perform open actuation in conjunction with open actuation of the outside lever; a locking/unlocking mechanism; a second open lever configured to perform open actuation in conjunction with open actuation of the first open lever output from the locking/unlocking mechanism; and a fully open release lever configured to perform open actuation in conjunction with open actuation of the first open lever, wherein the fully open release lever is connected to an operating force transmission member configured to transmit the open actuation of the fully open release lever to a fully opening latch device for holding the slide door in a fully open position.

7 Claims, 18 Drawing Sheets

(51) Int. Cl.

| | |
|---|---|
| ***E05B 79/16*** | (2014.01) |
| ***E05B 79/08*** | (2014.01) |
| ***E05B 81/20*** | (2014.01) |
| ***E05B 79/04*** | (2014.01) |

(56) References Cited

U.S. PATENT DOCUMENTS

| | | | | |
|---|---|---|---|---|
| 2014/0062101 | A1* | 3/2014 | Yokomori | E05B 83/40<br>292/100 |
| 2017/0067273 | A1* | 3/2017 | Yamashita | E05B 83/40 |
| 2017/0183893 | A1* | 6/2017 | Yamashita | E05B 77/26 |

FOREIGN PATENT DOCUMENTS

| | | | | |
|---|---|---|---|---|
| DE | 19924628 | A1 | 11/2000 | |
| JP | 4150655 | B2 * | 9/2008 | E05B 81/20 |
| JP | 4150655 | B2 | 9/2008 | |
| JP | 2015-224513 | A | 12/2015 | |

* cited by examiner

AUTOMOBILE DOOR LATCH DEVICE

The present application claims priority to and incorporates by reference the entire contents of Japanese Patent Application No. 2019-017591 filed in Japan on Feb. 4, 2019.

BACKGROUND

The present disclosure relates to an automobile door latch device.

Japanese Patent No. 4150655 discloses an example of an automobile door latch device for slide door including: a fully closing latch unit (a rear fully closing latch unit and a front fully closing latch unit) for holding a slide door in a closed state; a control unit including a locking/unlocking mechanism receiving the operating force of an outside handle and an inside handle to switch between an unlocked state to enable the input operation and a locked state to disable the input operation; a link unit that relays the operating force of the outside handle and the inside handle output from the control unit; and a fully opening latch unit for holding the slide door in a fully open position. The fully closing latch unit, the control unit, the link unit, and the fully opening latch unit are located away from each other, and these units are connected to each other through a plurality of operating force transmitting members (wire cables) in order to transmit the operating force of the outside handle and the inside handle output from the control unit to another unit.

As described above, Japanese Patent No. 4150655 discloses usage of a dedicated operating force transmission member for transmitting the operating force of the outside handle and the inside handle output from the control unit to each of the fully closing latch unit and the fully opening latch unit and therefore requires at least two or more operating force transmitting members. Moreover, there is a problem with workability in attaching the fully closing latch unit and the control unit to the slide door.

There is a need for an automobile door latch device with improved efficiency in workability in attachment to a slide door and with a reduced number of operating force transmitting members.

SUMMARY

In some embodiments, an automobile door latch device according to the present disclosure includes: a mesh mechanism including: a latch configured to mesh with a striker to hold a slide door in a closed position; and a ratchet configured to engage with the latch; a body configured to accommodate the mesh mechanism; a base fixed to the body; and an operation mechanism disposed on the base, the operation mechanism including: an outside lever pivotably supported on the base, and configured to receive an operating force of an outside handle disposed at the slide door to perform open actuation; a first open lever pivotably supported on the base, and configured to perform open actuation in conjunction with open actuation of the outside lever; a locking/unlocking mechanism supported on the base, and configured to be switchable between an unlocked state to enable output of open actuation of the first open lever and a locked state to disable the output of open actuation of the first open lever; a second open lever pivotably supported on the base, and configured to perform open actuation in conjunction with open actuation of the first open lever output from the locking/unlocking mechanism and allow the ratchet to perform unlatching actuation through the open actuation; and a fully open release lever pivotably supported on the base, and configured to perform open actuation in conjunction with open actuation of the first open lever, the fully open release lever being connected to an operating force transmission member configured to transmit the open actuation of the fully open release lever to a fully opening latch device for holding the slide door in a fully open position.

The above and other objects, features, advantages and technical and industrial significance of this disclosure will be better understood by reading the following detailed description of presently preferred embodiments of the disclosure, when considered in connection with the accompanying drawings.

DETAILED DESCRIPTION

An embodiment of the present disclosure will be described below with reference to the drawings.

Figure 1:
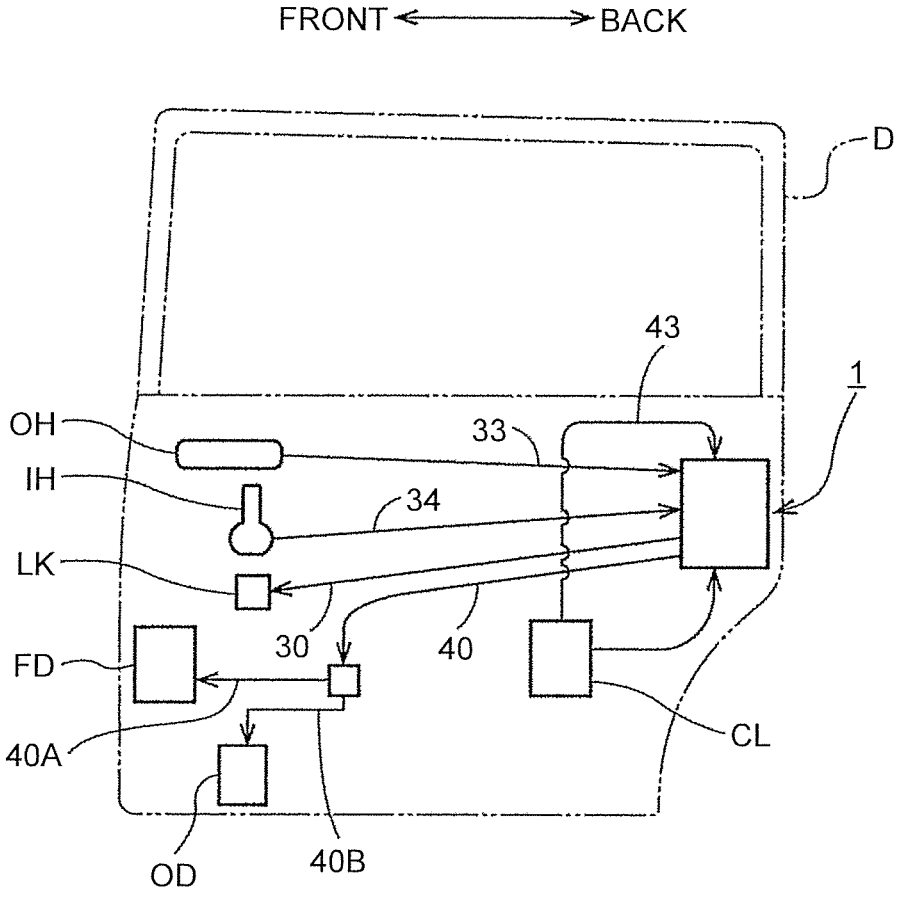
FIG. 1 is a schematic side view of a door to which an automobile door latch device according to an embodiment is applied.

FIG. 1 illustrates a slide door D which is supported on a not-illustrated guide rail in the front-back direction fixed to a side surface of the body of an automobile so as to open/close in the front-back direction.

On the outer surface (outer panel) of the slide door D, an outside handle OH is provided, which is operated when the slide door D is opened/closed from the outside of the vehicle. Similarly, on the inside surface on the interior side, an inside handle IH and a lock operation knob LK are provided. The inside handle IH is operated when the slide door D is opened/closed from the interior. The lock operation knob LK is operated when a rear door latch device 1 described later is manually operated to switch a locking/unlocking mechanism described later between the unlocked state and the locked state. Similarly, a front door latch device FD for holding the slide door D in a closed position is provided at the front section. Similarly, a fully opening latch unit OD for holding the slide door D in a fully open position is provided at the lower section. Similarly, a rear door latch device 1 (hereinafter referred to as "automobile door latch device 1") for holding the door D in a closed position together with the front door latch device FD and a closer device CL for actuating a latch 6 described later of the automobile door latch device 1 to forcibly close the slide door D from a half latch position (the position immediately before the fully closed position) to a full latch position (fully closed position) are provided at the rear section. A not-illustrated electrically powered opening/closing device for electrically opening/closing the slide door D is provided on the vehicle body, if necessary.

When the slide door D is in the fully open position, the fully opening latch unit OD is engaged with a not-illustrated fully opening striker provided on the vehicle body side to hold the slide door D in the fully open position. The engagement with the fully opening striker is released to enable the closing operation of the slide door D. A specific configuration of the fully opening latch unit OD is not directly pertinent to the present disclosure and a detailed description of the configuration is omitted. As used in the following description "unlatching actuation" of the fully opening latch unit OD refers to the actuation when the fully opening latch unit OD engaged with the fully opening striker is disengaged from the fully opening striker.

Figure 2:
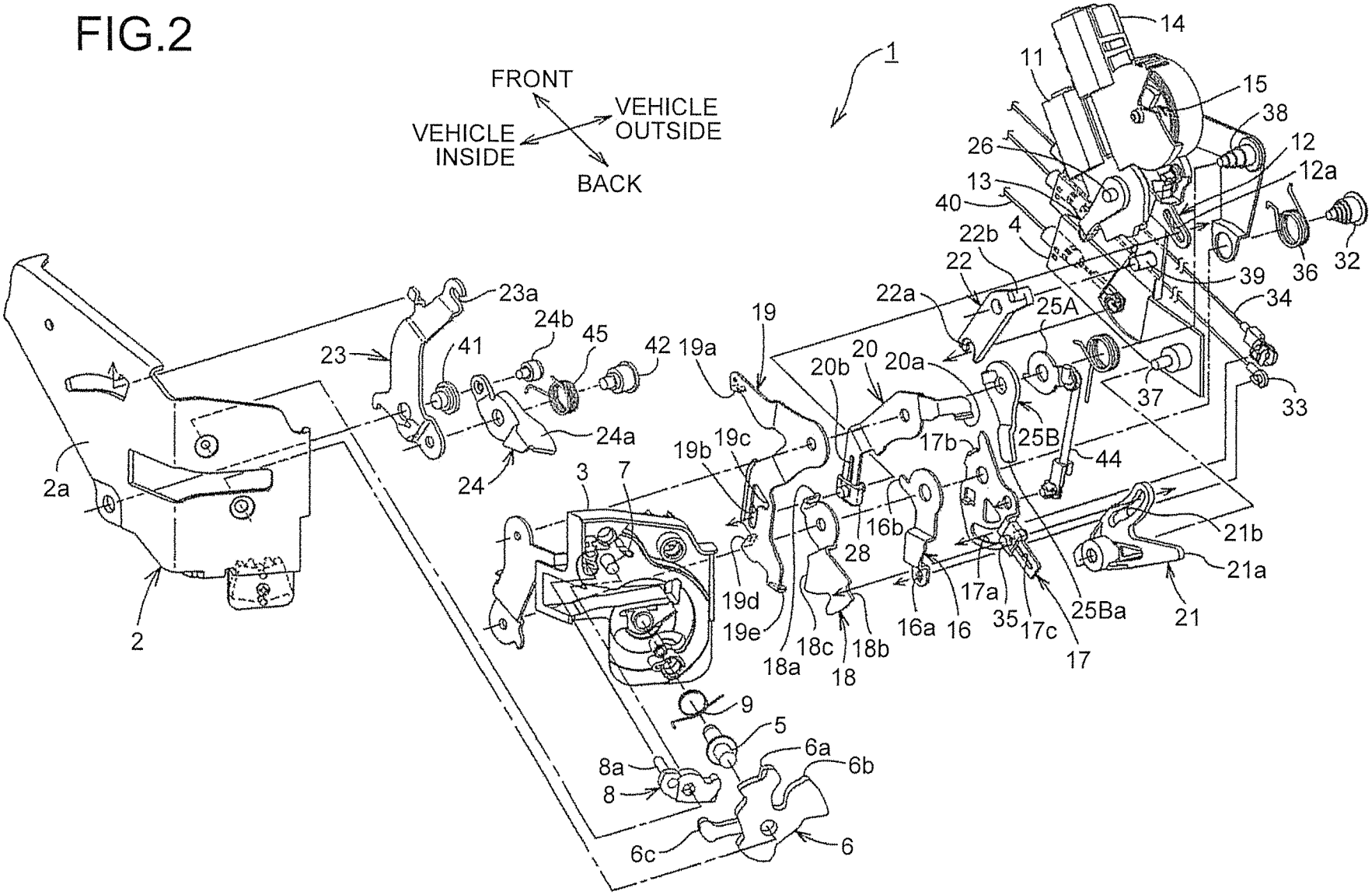
FIG. 2 is an exploded perspective view of the automobile door latch device.
Figure 3:
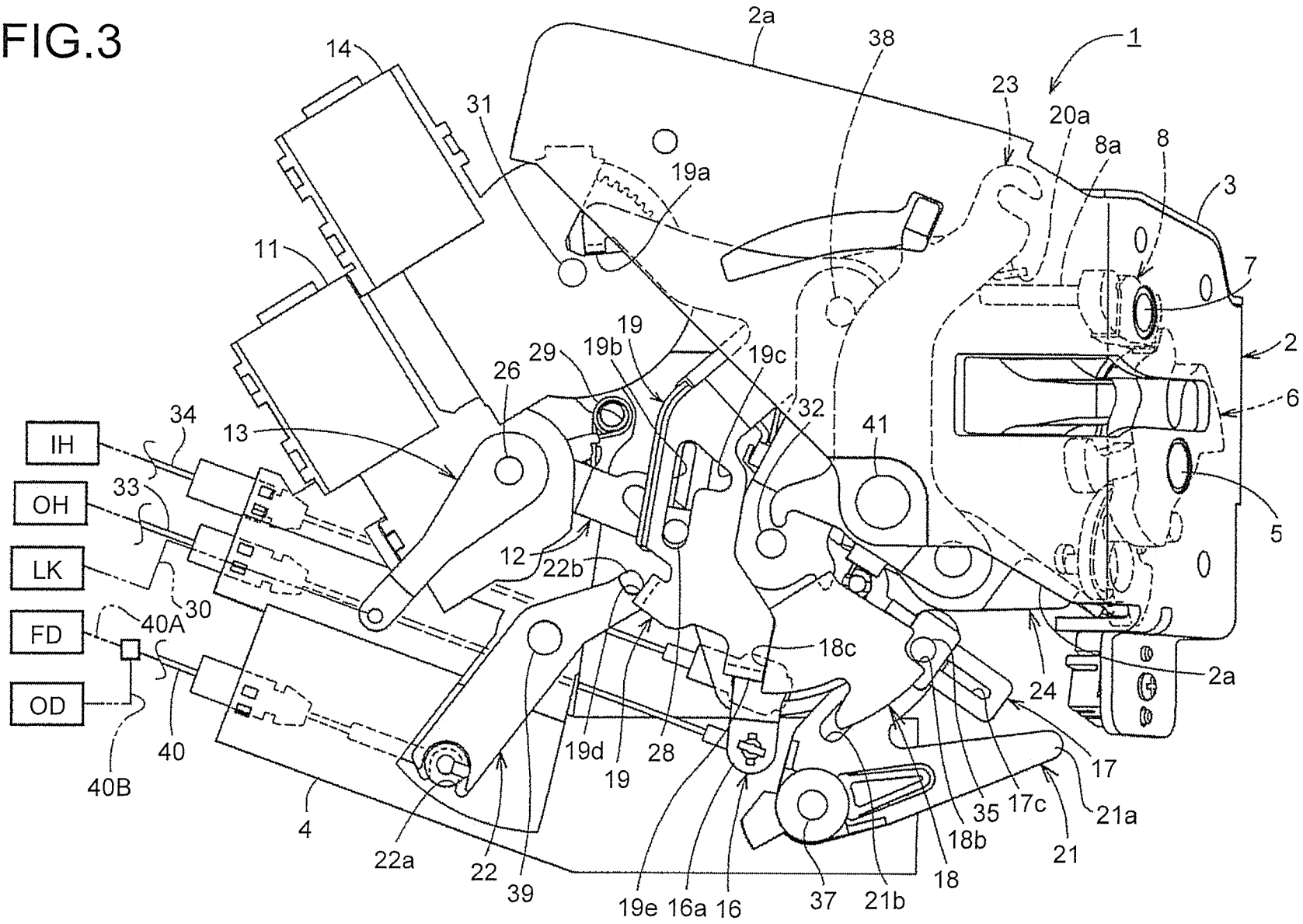
FIG. 3 is a side view of the automobile door latch device viewed from the inside of the vehicle.
Figure 4:
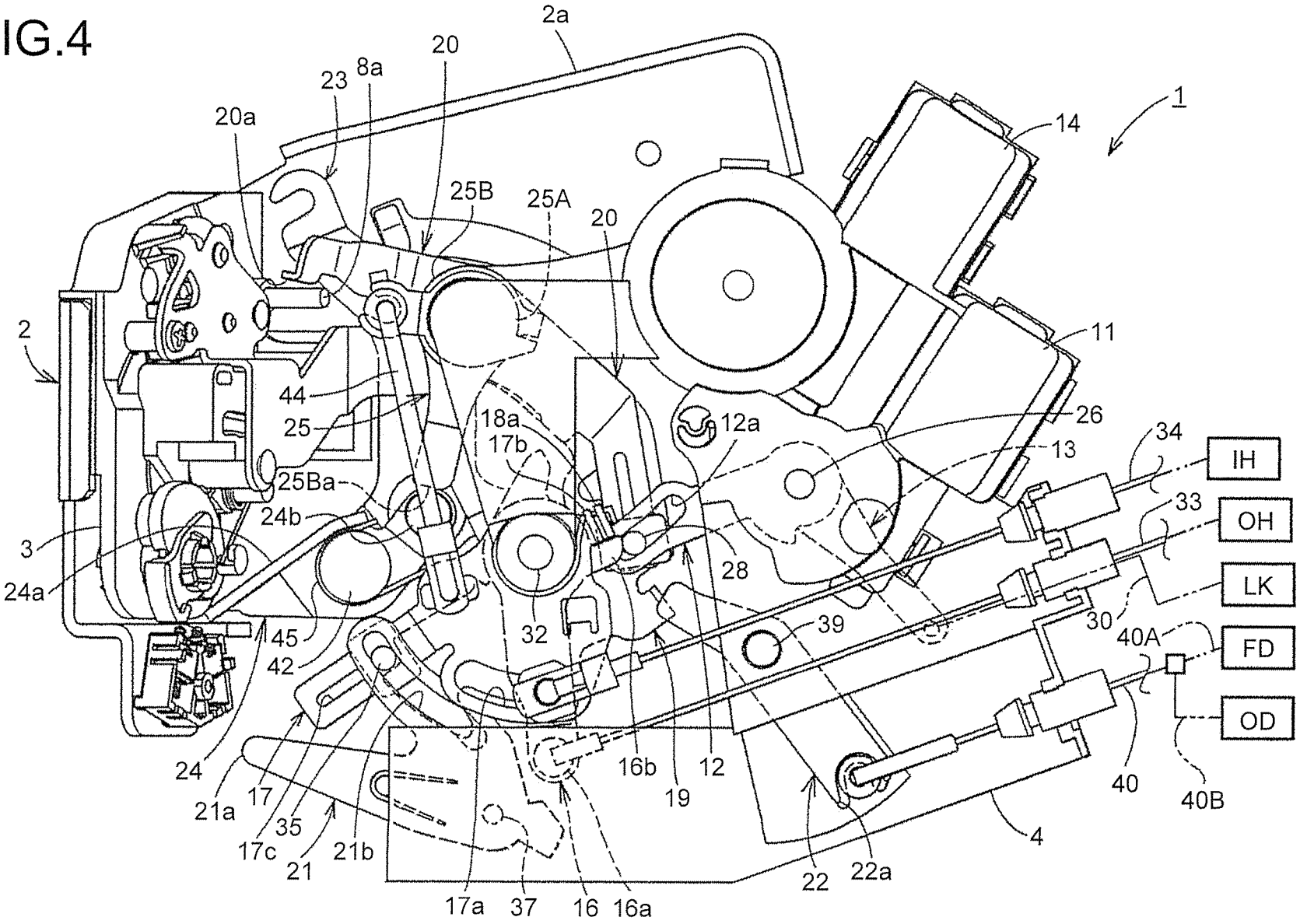
FIG. 4 is a side view of the automobile door latch device viewed from the outside of the vehicle.

As illustrated in FIGS. 2 to 4, the automobile door latch device 1 has a body 3 made of synthetic resin where a back surface of the body 3 is closed by a metal cover plate 2 and the body 3 is fixed to the inside of the rear end of the slide door D. A base plate 4 disposed in parallel with a side surface of an inner panel of the slide door D is fixed to the cover plate 2. The base plate 4 is also fixed to the body 3, if necessary.

A latch mechanism is accommodated between the cover plate 2 and the body 3. The latch mechanism includes a latch 6 and a ratchet 8. The latch 6 is pivotably supported by a latch shaft 5 oriented in the front-back direction and can be meshed with a striker S (see FIG. 5) on the vehicle body side when the slide door D is closed. The ratchet 8 is pivotably supported by a ratchet shaft 7 oriented in the front-back direction and can be selectively engaged with a full latch engagement portion 6*a* or a half latch engagement portion 6*b* provided on the outer peripheral edge of the latch 6.

An operation mechanism arrangement unit 2*a* formed integrally with the cover plate 2 fixed to the body 3 accommodating a mesh mechanism and the base plate 4 directly or indirectly fixed to the body 3 correspond to the base according to the present disclosure.

On the base plate 4 or the operation mechanism arrangement unit 2*a*, the following components that configure an operation mechanism are disposed: a locking/unlocking motor 11, a lock lever 12, a knob lever 13, an opening motor 14, an opening rotor 15, an outside lever 16, a first inside lever 17, a second inside lever 18, a first open lever 19, a second open lever 20, a child-proof lever 21, a fully open release lever 22, a first closer lever 23, a second closer lever 24, a first closer cancel lever 25A, and a second closer cancel lever 25B.

Figure 5:
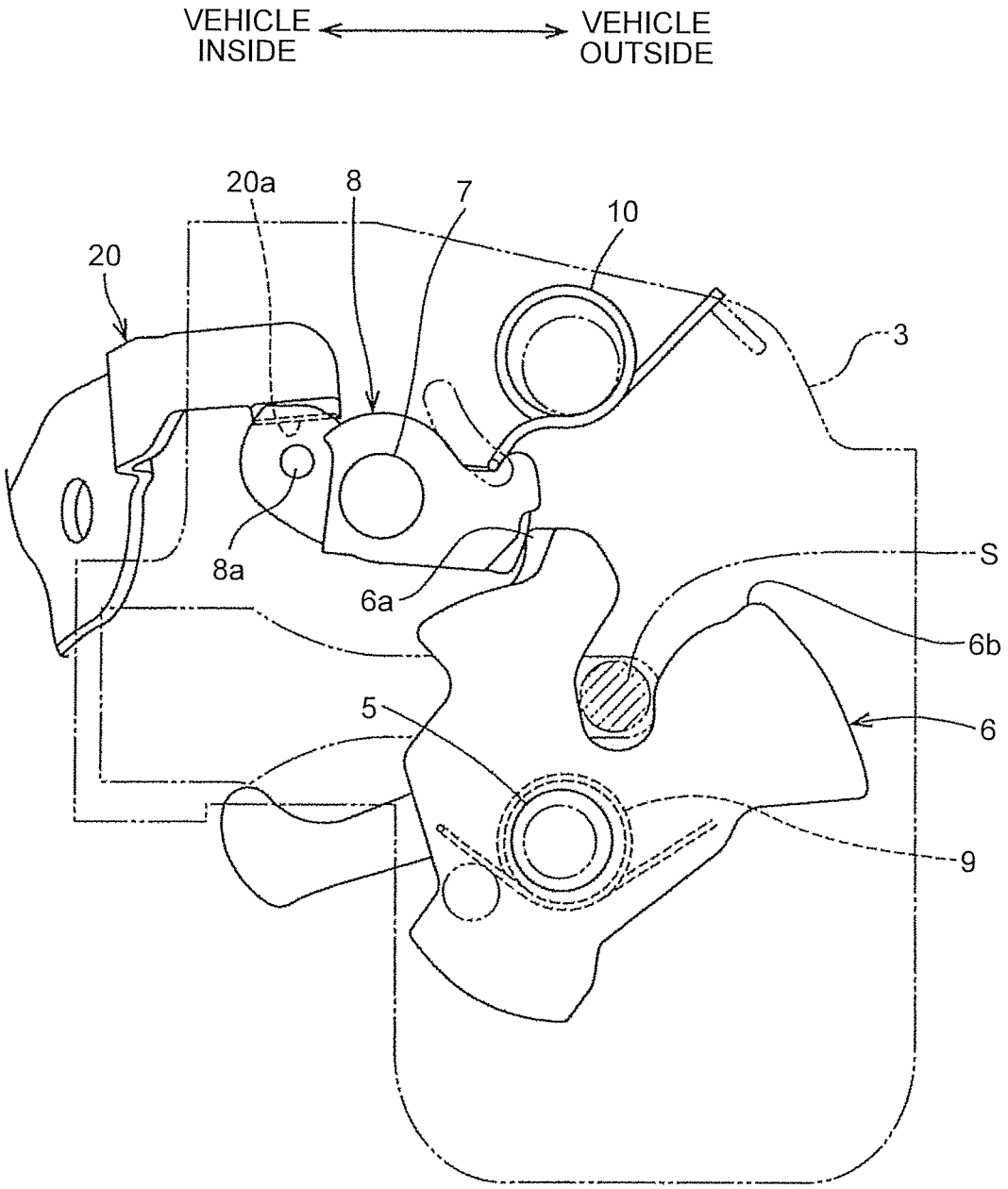
FIG. 5 is a front view of the main part of a latch mechanism of the automobile door latch device.

As illustrated in FIG. 5, the latch 6 can pivot from an open position (the position rotated by about 90 degrees counterclockwise from a full latch position depicted by a solid line in FIG. 5) corresponding to the open position of the slide door D not meshed with the striker S to a full latch position (the position illustrated in FIG. 5) completely meshed with the striker S via a half latch position rotated by a predetermined angle in the closing direction (clockwise in FIG. 5) against the biasing force of a spring 9 wound around the latch shaft 5, and barely meshed with the striker S.

The ratchet 8 is normally biased in the engagement direction (clockwise in FIG. 5) by the biasing force of a spring 10 supported on the body 3, abuts on the outer peripheral edge of the latch 6 when the latch 6 is in the open position, engages with the half latch engagement portion 6*b* when the latch 6 is in the half latch position, engages with the full latch engagement portion 6*a* when the latch 6 is in the full latch position, and performs open actuation (pivotal movement counterclockwise in FIG. 5) against the biasing force of the spring 10 from the engagement position in engagement with the full latch engagement portion 6*a* or the half latch engagement portion 6*b* and then disengages from the full latch engagement portion 6*a* or the half latch engagement portion 6*b* to permit pivoting of the latch 6 in the open direction (counterclockwise in FIG. 5), thereby enabling the opening operation of the slide door D.

As used in the following description the "latched state" of the latch mechanism refers to a state in which the striker S is engaged with the latch 6 and the ratchet 8 is engaged with the full latch engagement portion 6*a* or the half latch engagement portion 6*b* of the latch 6. The "unlatched state" refers to the state in which the latch 6 is in the open position. The "unlatching actuation" refers to the actuation when the ratchet 8 performs open actuation and disengages from the full latch engagement portion 6*a* or the half latch engagement portion 6*b* of the latch 6.

Figure 6:
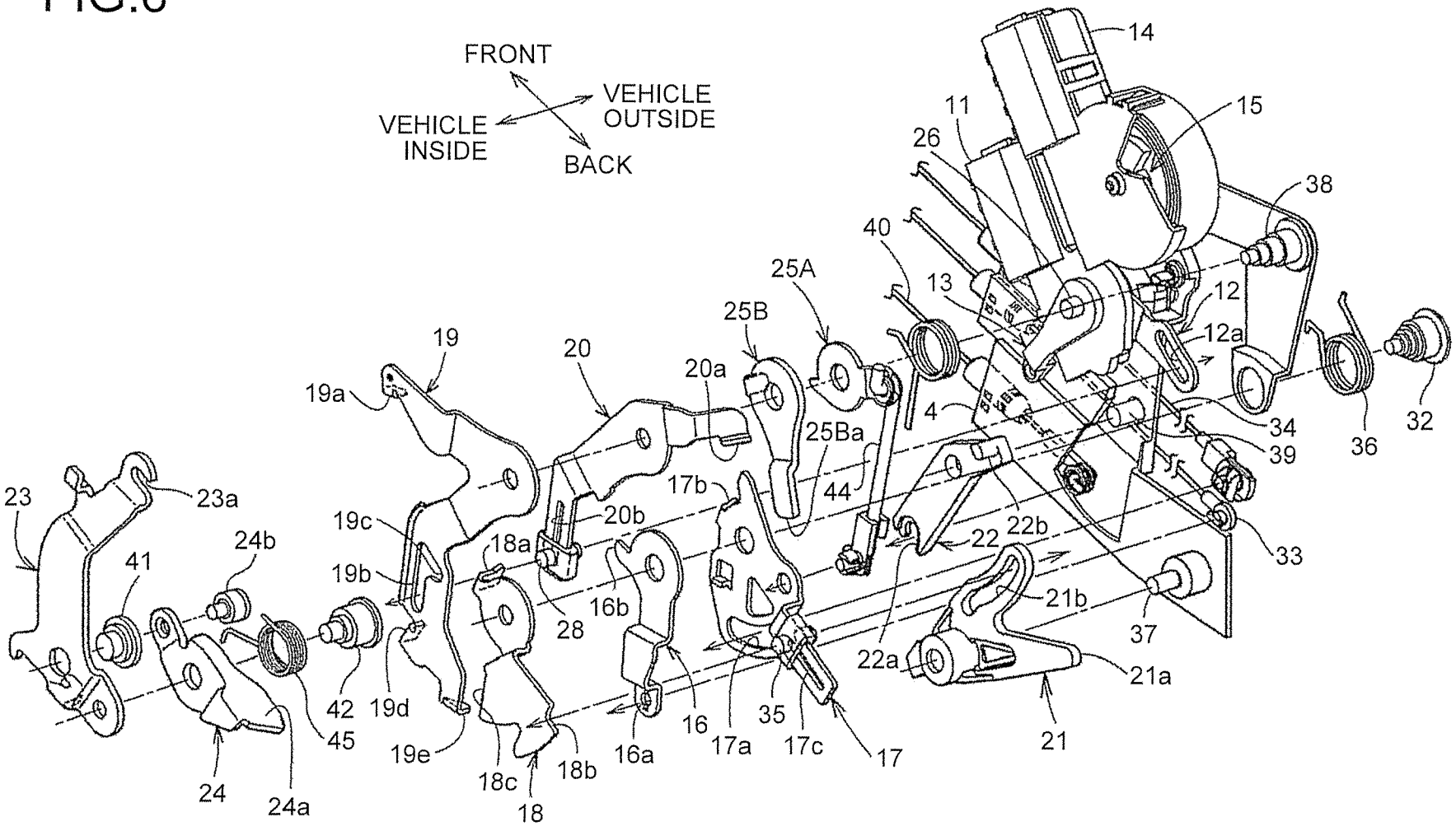
FIG. 6 is an exploded perspective view of an operation mechanism of the automobile door latch device.
Figure 7:
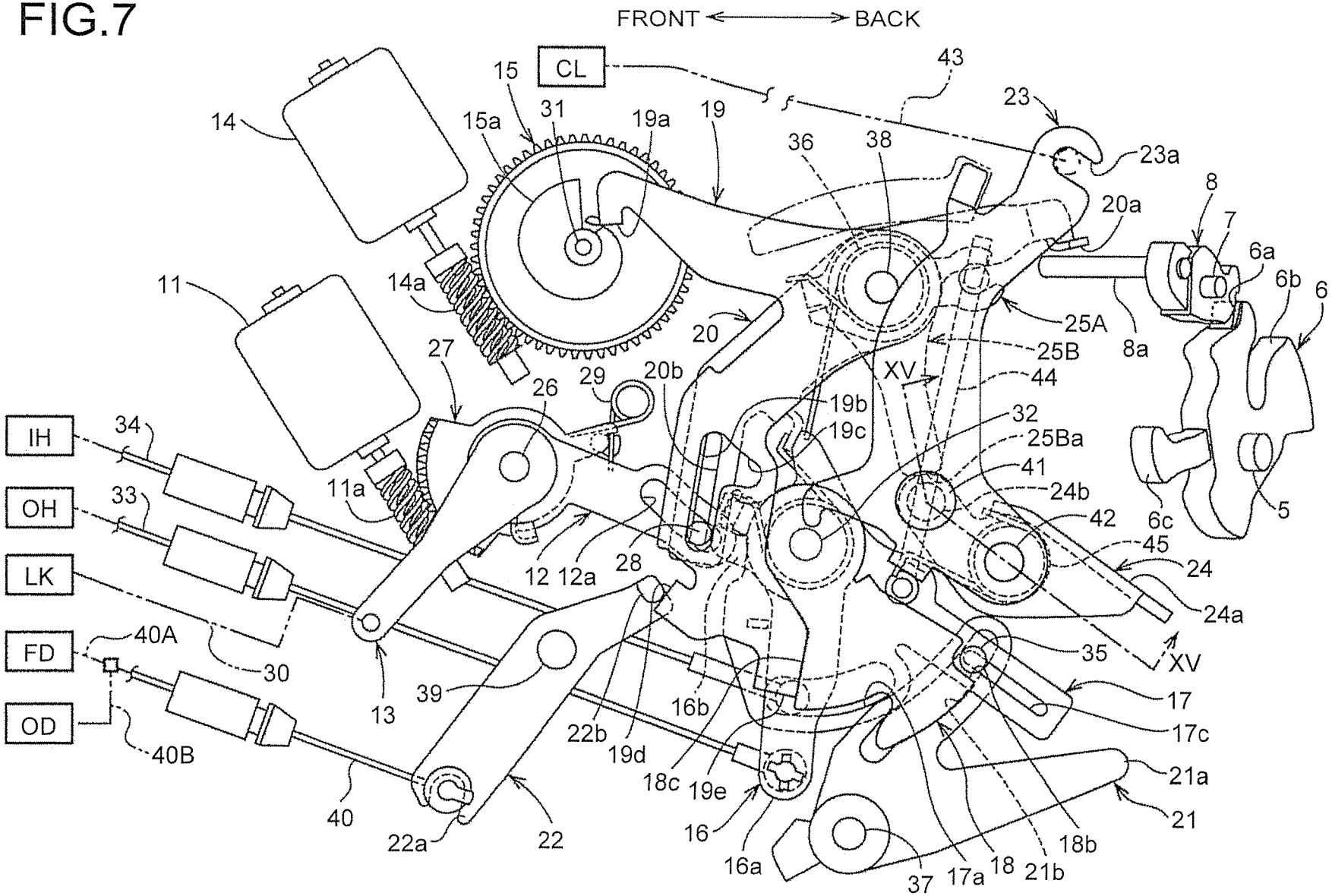
FIG. 7 is a side view of the main part of the automobile door latch device in an initial state.

FIG. 6 is an exploded perspective view of the operation mechanism. FIG. 7 is a side view of the main part when the operation mechanism is in an initial state. FIGS. 8 to 14 are actuation illustrations illustrating a state in which any operating system element is actuated in a manner corresponding to each operation. In FIGS. 8 to 14, for easy visibility of the actuation state of each operation system element, the operating system element kept in the initial position is indicated by a chain double-dashed line, the operating system element actuated to a position other than the initial position is indicated by a solid line, and the actuation direction is indicated by an arrow.

The locking/unlocking motor 11 drives forward rotation or reverse rotation in response to a lock/unlock operation of an operation switch provided at an appropriate place of the vehicle or a portable wireless operation switch. A worm 11*a* fixed to the rotation shaft of the locking/unlocking motor 11 is meshed with a locking/unlocking rotor 27 formed of a sector gear pivotably supported on the base plate 4 by a pivot 26 to allow the locking/unlocking rotor 27 to make forward rotation or reverse rotation.

Figure 9:
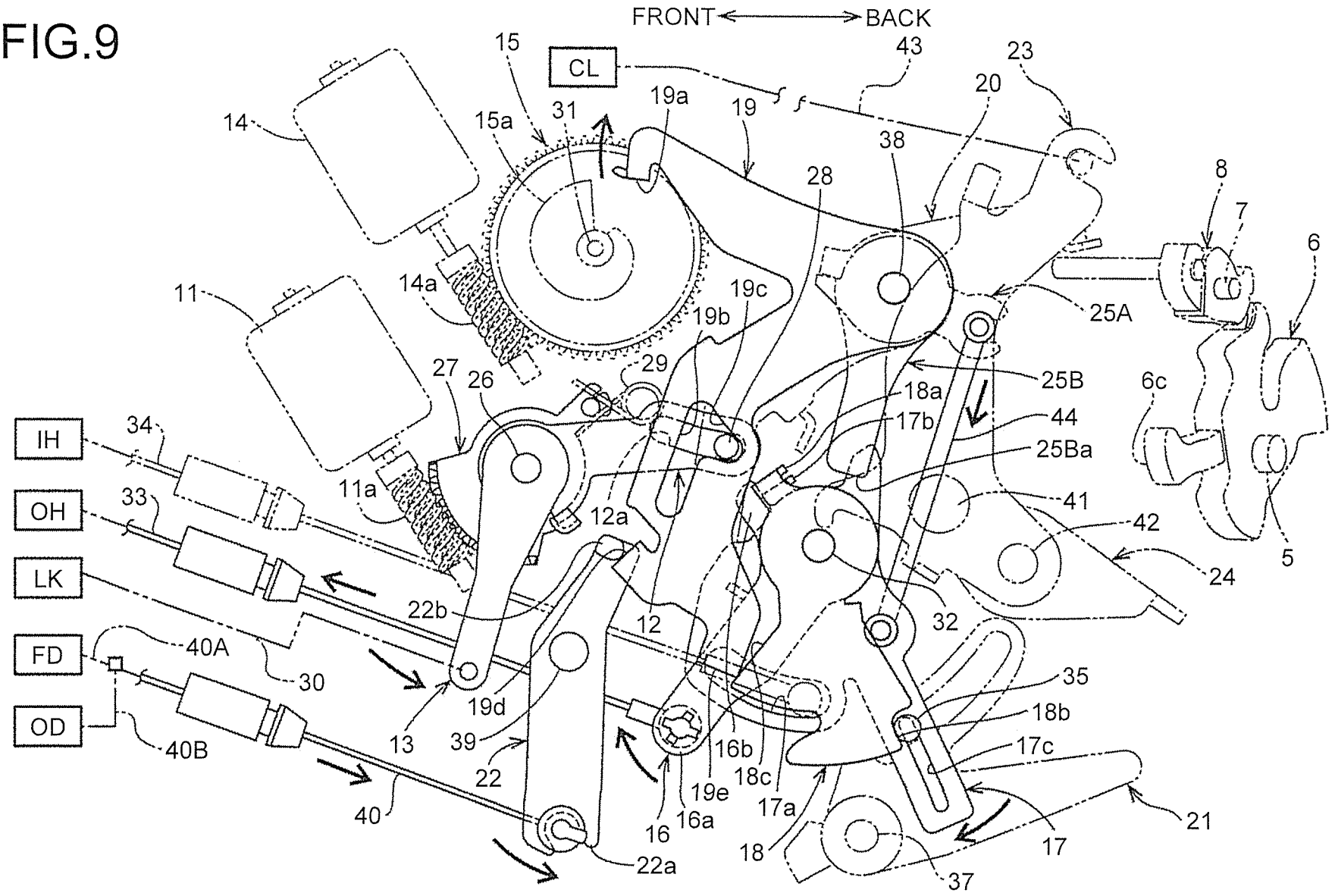
FIG. 9 is an actuation illustration in which the outside handle is operated with the locking/unlocking mechanism in the locked state.

The locking/unlocking rotor 27 can pivot to an unlocked position (initial position) illustrated in FIG. 7 to set the locking/unlocking mechanism of the automobile door latch device 1 in the unlocked state and to a locked position illustrated in FIG. 9 pivoted by a predetermined angle counterclockwise from the unlocked position to set the locking/unlocking mechanism to the locked state. The locking/unlocking rotor 27 is elastically held at each position by the biasing force of a turnover spring 29 supported on the base plate 4.

The locking/unlocking mechanism includes a lock lever 12 and a first lock pin 28 described later. The unlocked state refers to a state in which the lock lever 12 and the first lock pin 28 are in the unlocked position illustrated in FIG. 7, and transmission of the open actuation of the first open lever 19 (pivotal movement clockwise in FIG. 7) to the second open lever 20 is enabled so that the slide door D can be opened by operating either the outside handle OH or the inside handle IH. The locked state refers to a state in which the lock lever 12 and the first lock pin 28 are in the locked position illustrated in FIG. 9, and transmission of the open actuation of the first open lever 19 to the second open lever 20 is disabled so that the slide door D is unable to be opened even by operating either the outside handle OH or the inside handle IH.

The lock lever 12 is pivotably supported by the pivot 26 to be rotatable integrally with the locking/unlocking rotor 27 and can pivot to an unlocked position illustrated in FIG. 7 and to a locked position illustrated in FIG. 9 in which it pivots from the unlocked position counterclockwise by a predetermined angle together with the locking/unlocking rotor 27. The lock lever 12 has an elongated hole 12*a* in the front-back direction, with which the first lock pin 28 described later is slidably engaged in the front-back direction.

The knob lever 13 is pivotably supported by the pivot 26 to be rotatable integrally with the lock lever 12 and the locking/unlocking rotor 27 and can pivot to an unlocked position illustrated in FIG. 7 and to a locked position illustrated in FIG. 9 in which it pivots from the unlocked position counterclockwise by a predetermined angle. The lock lever 12 and the knob lever 13 thus can pivot from the unlocked position to the locked position and vice versa through the electrically powered operation by power of the locking/unlocking motor 11.

The lower end of the knob lever 13 is connected to one end of an operating force transmission member 30 formed of a Bowden cable or a rod having the other end connected to the lock operation knob LK. With this configuration, the lock lever 12, the knob lever 13, and the locking/unlocking rotor 27 can pivot to the unlocked position and the locked position against the biasing force of the turnover spring 29 even through manual locking/unlocking operation of the lock operation knob LK.

The opening motor 14 drives forward rotation in response to operation of an operation switch provided at an appropriate place of the automobile or a wireless operation switch, or a not-illustrated detection switch detecting operation of the outside handle OH or the inside handle IH. The driving allows a worm 14*a* fixed to the rotation shaft to mesh with the opening rotor 15 formed of a worm wheel pivotably supported by a pivot 31 on the base plate 4, thereby rotating the opening rotor 15 in the open direction (counterclockwise in FIG. 7).

On a rotating surface of the opening rotor 15, a cam 15*a* is provided for rotating the first open lever 19 in the open direction (clockwise in FIG. 7) as the opening rotor 15 rotates in the open direction.

The outside lever 16 is pivotably supported on the base plate 4 by a pivot 32. The outside handle OH is connected to an input portion 16*a* provided at the lower end of the outside lever 16 through an operating force transmission member 33 formed of a Bowden cable or a rod. The operating force of the outside handle OH is input to the input portion 16*a* of the outside lever 16 through the operating force transmission member 33. With this configuration, the outside lever 16 performs open actuation (pivotal movement clockwise in FIG. 7) from the initial position illustrated in FIG. 7, based on the operation of the outside handle OH.

The outside lever 16 has a pawl-like output portion 16*b* for transmitting its open actuation to the first inside lever 17 and the second inside lever 18. With this configuration, when the outside lever 16 performs open actuation, the actuation is always transmitted to the first inside lever 17 and the second inside lever 18.

The first inside lever 17 is pivotably supported on the base plate 4 by the pivot 32 to be rotatable independently of the outside lever 16. The first inside lever 17 has an elongated hole 17*a* in the front-back direction at the lower portion thereof. The inside handle IH is connected to the elongated hole 17*a* through an operating force transmission member 34 formed of a Bowden cable or a rod. The operating force of the inside handle IH is transmitted to the first inside lever 17 through the operating force transmission member 34.

The first inside lever 17 also has an input portion 17*b* on which the output portion 16*b* of the outside lever 16 comes into abutment in a rotation direction when the outside lever 16 performs open actuation, and an elongated hole 17*c* extending obliquely downward to the back. A second lock pin 35 that slides in the longitudinal direction with actuation of the child-proof lever 21 is engaged in the elongated hole 17*c*.

As described above, the first inside lever 17 performs open actuation from the initial position illustrated in FIG. 7 (pivotal movement clockwise in FIG. 7) against the biasing force of a spring 36 wound around the pivot 32, based on the open actuation of the outside lever 16 in accordance with the operation of the inside handle IH and the operation of the outside handle OH. When the first inside lever 17 performs open actuation based on the operation of the inside handle IH, the actuation is not transmitted to the outside lever 16.

The second inside lever 18 is pivotably supported on the base plate 4 by the pivot 32 to be rotatable independently of the outside lever 16 and the first inside lever 17. The second inside lever 18 has a first input portion 18*a* on which the output portion 16*b* of the outside lever 16 comes into abutment in the rotation direction to input the open actuation of the outside lever 16 when the outside lever 16 performs open actuation, a second input portion 18*b* to which the open actuation of the first inside lever 17 can be input when the child-proof lever 21 and the second lock pin 35 are in the unlocked position described later and to which the open actuation of the first inside lever 17 is unable to be input when the child-proof lever 21 and the second lock pin 35 are in the locked position described later, and an output portion 18*c* for transmitting the open actuation of the second inside lever 18 to the first open lever 19.

With this configuration, for the open actuation of the outside lever 16 through the operation of the outside handle OH, the second inside lever 18 normally performs open actuation in conjunction with the outside lever 16, whereas for the open actuation of the first inside lever 17 through the operation of the inside handle IH, the second inside lever 18 performs open actuation (pivotal movement clockwise in FIG. 7) from the initial position illustrated in FIG. 7 against the biasing force of the spring 36 in accordance with the open actuation of the first inside lever 17, only when the child-proof lever 21 and the second lock pin 35 are in the unlocked position.

The child-proof lever 21 is pivotably supported on the base plate 4 by a pivot 37. An operation part 21*a* protruding from the back end surface of the slide door D is manually operated so that the child-proof lever 21 can pivot to an unlocked position illustrated in FIG. 7 and to a locked position illustrated in FIG. 11 rotated from the unlocked position clockwise by a predetermined angle. The child-proof lever 21 has an elongated hole 21*b* (an arc hole around the pivot 32) with which the second lock pin 35 slidably engaged with the elongated hole 17*c* of the first inside lever 17 is slidably engaged in the arc direction of the elongated hole 21*b*.

Figure 11:
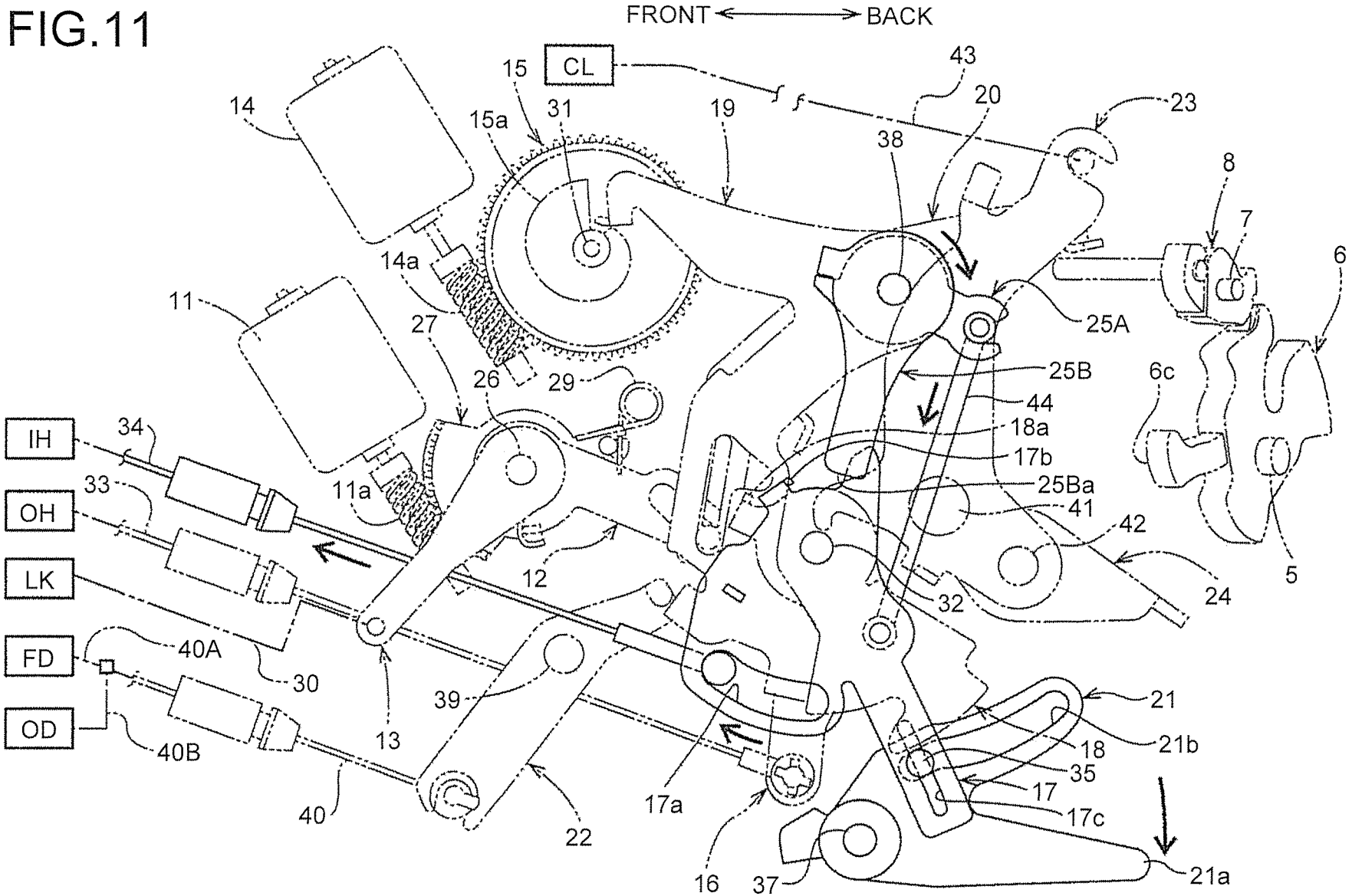
FIG. 11 is an actuation illustration in which the inside handle is operated with the child-proof mechanism in the locked state.

The second lock pin 35 is held in the unlocked position where it can abut on the second input portion 18*b* of the second inside lever 18 when the child-proof lever 21 is in the unlocked position, as illustrated in FIG. 7. The second lock pin 35 retreats to the locked position in which it is unable to abut on the second input portion 18*b* of the second inside lever 18 when the child-proof lever 21 is in the locked position, as illustrated in FIG. 11.

In this configuration, when the child-proof lever 21 and the second lock pin 35 are in the unlocked position, the open actuation of the first inside lever 17 is transmitted to the second inside lever 18 through the second lock pin 35 to allow the second inside lever 18 to perform open actuation (pivotal movement clockwise in FIG. 7). When the child-proof lever 21 and the second lock pin 35 are in the locked position, the open actuation of the first inside lever 17 is not transmitted to the second inside lever 18, because the second lock pin 35 does not abut on the second input portion 18*b* of the second inside lever 18 even if the first inside lever 17 performs open actuation.

The child-proof mechanism includes the child-proof lever 21 and the second lock pin 35. The unlocked state of the child-proof mechanism refers to a state in which transmission of the open actuation (pivotal movement clockwise in FIG. 7) of the first inside lever 17 to the second inside lever 18 is enabled. The locked state of the child-proof mechanism refers to a state in which transmission of the open actuation of the first inside lever 17 to the second inside lever 18 is disabled.

The first open lever 19 is pivotably supported on the base plate 4 by a pivot 38 and has an arm extending forward. At the tip end of the arm, a slidable contact portion 19*a* is provided, which can slidably touch the cam surface of the cam 15*a* of the opening rotor 15. With this configuration, when the opening rotor 15 is rotated counterclockwise from the initial position illustrated in FIG. 7 by driving of the opening motor 14 to reach the position illustrated in FIG. 12, the first open lever 19 performs open actuation (pivotal movement counterclockwise in FIG. 7) from the initial position illustrated in FIG. 7 to pivot to the actuated position illustrated in FIG. 12. After the first open lever 19 performs open actuation, the opening rotor 15 returns to the initial position by the biasing force of a not-illustrating spring acting on the opening rotor 15.

The first open lever 19 also has a transmission hole 19*b* extending in the up-down direction and with which the first lock pin 28 is slidably engaged in the up-down direction, an escape hole 19*c* extending obliquely downward to the back from the upper end of the transmission hole 19*b*, an output portion 19*d* for transmitting the open actuation of the first open lever 19 to the fully open release lever 22, and an input portion 19*e* for inputting the open actuation of the second inside lever 18. Preferably, the escape hole 19*c* is shaped like an arc around the pivot 38.

The first lock pin 28 is engaged with the elongated hole 12*a* of the lock lever 12 slidably only in its longitudinal direction. Thus, as illustrated in FIG. 7, the first lock pin 28 is positioned at the lower end of the transmission hole 19*b* when the lock lever 12 is in the unlocked position, and is positioned at the upper end of the transmission hole 19*b* when the lock lever 12 pivots to the locked position.

In this configuration, when the lock lever 12 is in the unlocked position as illustrated in FIG. 7, the open actuation of the first open lever 19 allows the first lock pin 28 to engage with the transmission hole 19*b*, so that the open actuation of the first open lever 19 is transmitted to the second open lever 20 through the first lock pin 28. When the lock lever 12 is in the locked position as illustrated in FIG. 9, the open actuation of the first open lever 19 only allows the first lock pin 28 to relatively move in the escape hole 19*c* in accordance with the open actuation of the first open lever 19, and the open actuation of the first open lever 19 is not transmitted to the second open lever 20.

When the first open lever 19 performs open actuation, the output portion 19*d* of the first open lever 19 comes into abutment with a input portion 22*b* provided at the upper end of the fully open release lever 22 to transmit the open actuation of the first open lever 19 to the fully open release lever 22. Similarly, when the second inside lever 18 performs open actuation, the input portion 19*e* comes into abutment with the output portion 18*c* of the second inside lever 18 to input the open actuation of the second inside lever 18. In this configuration, the first open lever 19 performs open actuation by the open actuation of the second inside lever 18 in addition to rotation of the opening rotor 15 by driving of the opening motor 14.

As described above, when the child-proof lever 21 and the second lock pin 35 are in the unlocked position, the first open lever 19 performs open actuation in conjunction with rotation of the opening rotor 15 by driving of the opening motor 14 and the open actuation of the second inside lever 18 by the operation of the outside handle OH and the operation of the inside handle IH, irrespective of whether the lock lever 12 and the first lock pin 28 are in the unlocked position or the locked position. When the child-proof lever 21 and the second lock pin 35 are in the locked position, the first open lever 19 is able to perform open actuation by rotation of the opening rotor 15 by driving of the opening motor 14 and the operation of the outside handle OH, but is unable to perform open actuation with the operation of the inside handle IH.

The second open lever 20 is pivotably supported on the base plate 4 by the pivot 38 to be rotatable independently of the first open lever 19. The second open lever 20 has an output portion 20*a* at the back end of an arm extending backward for allowing the ratchet 8 to perform open actuation, and an elongated hole 20*b* in which the first lock pin 28 is engaged to be slidable in the up-down direction and not to be slidable in the rotation direction around the pivot 38.

When performing open actuation (pivotal movement clockwise in FIG. 7), the output portion 20*a* of the second open lever 20 comes into abutment from above on a shaft-like input portion 8*a* fixed to the ratchet 8 to allow the ratchet 8 to perform open actuation.

When the lock lever 12 is in the unlocked position and the first lock pin 28 is positioned at the lower end of the transmission hole 19*b* of the first open lever 19, the first lock pin 28 abuts on the elongated hole 20*b* while orbiting the pivot 38 in accordance with the open actuation of the first open lever 19, and thus the open actuation of the first open lever 19 can be transmitted to the second open lever 20. When the lock lever 12 is in the locked position and the first lock pin 28 is positioned at the upper end of the transmission hole 19*b* of the first open lever 19, the open actuation of the first open lever 19 only allows the first lock pin 28 to relatively move in the escape hole 19*c* of the first open lever 19, and the open actuation of the first open lever 19 is not transmitted to the second open lever 20.

As described above, when the lock lever 12 and the first lock pin 28 are in the unlocked position and the child-proof lever 21 and the second lock pin 35 are in the unlocked position, the second open lever 20 enables transmission of the operating force of the outside handle OH, the operating force of the inside handle IH, and the driving of the opening motor 14 to the ratchet 8 and enables opening of the slide door D. When the lock lever 12 and the first lock pin 28 are in the locked position and the child-proof lever 21 and the second lock pin 35 are in the unlocked position or the locked position, the second open lever 20 disables transmission of the operating force of the outside handle OH, the operating force of the inside handle IH, and the driving of the opening motor 14 to the ratchet 8 and disables the opening operation of the slide door D. When the lock lever 12 and the first lock pin 28 are in the unlocked position and the child-proof lever 21 and the second lock pin 35 are in the locked position, the second open lever 20 enables transmission of the operating force of the outside handle OH and the driving of the opening motor 14 to the ratchet 8 and enables the opening operation of the slide door D, but disables transmission of the operating force of the inside handle IH to the ratchet 8 to disable the opening operation of the slide door D.

The fully open release lever 22 is pivotably supported on the base plate 4 by a pivot 39 and has the input portion 22*b* at the upper end for inputting the open actuation of the first open lever 19. An output portion 22*a* provided at the lower end of the fully open release lever 22 is connected to an operating force transmission member 40 formed of a Bowden cable or a rod for transmitting the open actuation of the fully open release lever 22 (pivotable movement counterclockwise in FIG. 7) to the front door latch device FD and the fully opening latch unit OD.

Preferably, the operating force transmission member 40 branches into operating force transmission members 40A and 40B on the way from the fully open release lever 22 to the front door latch device FD and the fully opening latch unit OD so that the open actuation of the fully open release lever 22 can be transmitted to each of the front door latch device FD and the fully opening latch unit OD.

When the first open lever 19 performs open actuation, the output portion 19*d* of the first open lever 19 comes into abutment with the input portion 22*b* of the fully open release lever 22 to input the open actuation of the first open lever 19. When the open actuation of the first open lever 19 is input to the input portion 22*b*, the fully open release lever 22 performs open actuation.

The open actuation of the fully open release lever 22 is transmitted to each of the front door latch device FD and the fully opening latch unit OD through the operating force transmission member 40, so that each of the front door latch device FD and the fully opening latch unit OD performs unlatching actuation. With this configuration, when the slide door D is in the closed position, the opening operation of the slide door D is enabled based on the unlatching actuation of the front door latch device FD. When the slide door D is in the fully open position, the closing operation of the slide door D is enabled based on the unlatching actuation of the fully opening latch unit OD.

Accordingly, if the child-proof lever 21 and the second lock pin 35 are in the unlocked position, irrespective of whether the lock lever 12 and the first lock pin 28 are in the unlocked position or the locked position, the electrically powered operation by the opening motor 14, the operation of the outside handle OH, and the operation of the inside handle IH allow the fully open release lever 22 to perform open actuation through the first open lever 19 and allow the fully opening latch unit OD and the front door latch device FD to perform unlatching actuation, thereby enabling the closing operation of the slide door D if the slide door D is in the fully open position. However, when the lock lever 12 and the first lock pin 28 are in the locked position, the open actuation of the first open lever 19 is not transmitted to the ratchet 8 and therefore the slide door D will not open even when the front door latch device FD performs unlatching actuation.

The first closer lever 23 is pivotably supported on the operation mechanism arrangement unit 2*a* by a pivot 41 oriented in the right-left direction. An input portion 23*a* at the upper end of the first closer lever 23 is connected to one end of an operating force transmission member 43 formed of a Bowden cable or a rod with the other end connected to a not-illustrated output lever of the closer device CL. The motor of the closer device CL drives so that the output lever of the closer device CL pivots in a predetermined direction by a predetermined angle. With this configuration, when the output lever pivots, the pivotal movement is input to the input portion 23*a* of the first closer lever 23 through the operating force transmission member 43, so that the first closer lever 23 performs close actuation (pivotal movement counterclockwise in FIG. 7) from the initial position illustrated in FIG. 7.

The second closer lever 24 is pivotably connected to the lower end of the first closer lever 23 by a joint shaft 42 oriented in the right-left direction (the vehicle interior-exterior direction).

The second closer lever 24 is pivotably connected to the first closer lever 23 by a joint shaft 42 and biased by a spring 45 counterclockwise in FIG. 7 to normally stop at the initial position illustrated in FIG. 7. At the back end of the second closer lever 24, an output portion 24*a* is provided, which can come into abutment with an arm 6*c* of the latch 6 from below when the first closer lever 23 performs close actuation. A cylindrical virtual shaft 24*b* is provided at the front end of the second closer lever 24. The center of the virtual shaft 24*b* coincides with the center of the pivot 41 serving as the rotation center of the first closer lever 23 when the second closer lever 24 is in the initial position. Accordingly, supposing that the second closer lever 24 is unable to pivot relative to the first closer lever 23, the second closer lever 24 pivots about the pivot 41 together with the first closer lever 23 when the first closer lever 23 pivots.

The first closer cancel lever 25A and the second closer cancel lever 25B are pivotably supported by the pivot 38 shared by the first open lever 19 and the second open lever 20 to be independently rotatable.

The back end of the first closer cancel lever 25A is connected to the first inside lever 17 through a joint rod 44 movable in the up-down direction. With this configuration, the first closer cancel lever 25A performs cancel actuation (pivotal movement clockwise in FIG. 7) around the pivot 38 from the initial position illustrated in FIG. 7, in conjunction with the open actuation of the first inside lever 17.

Figure 14:
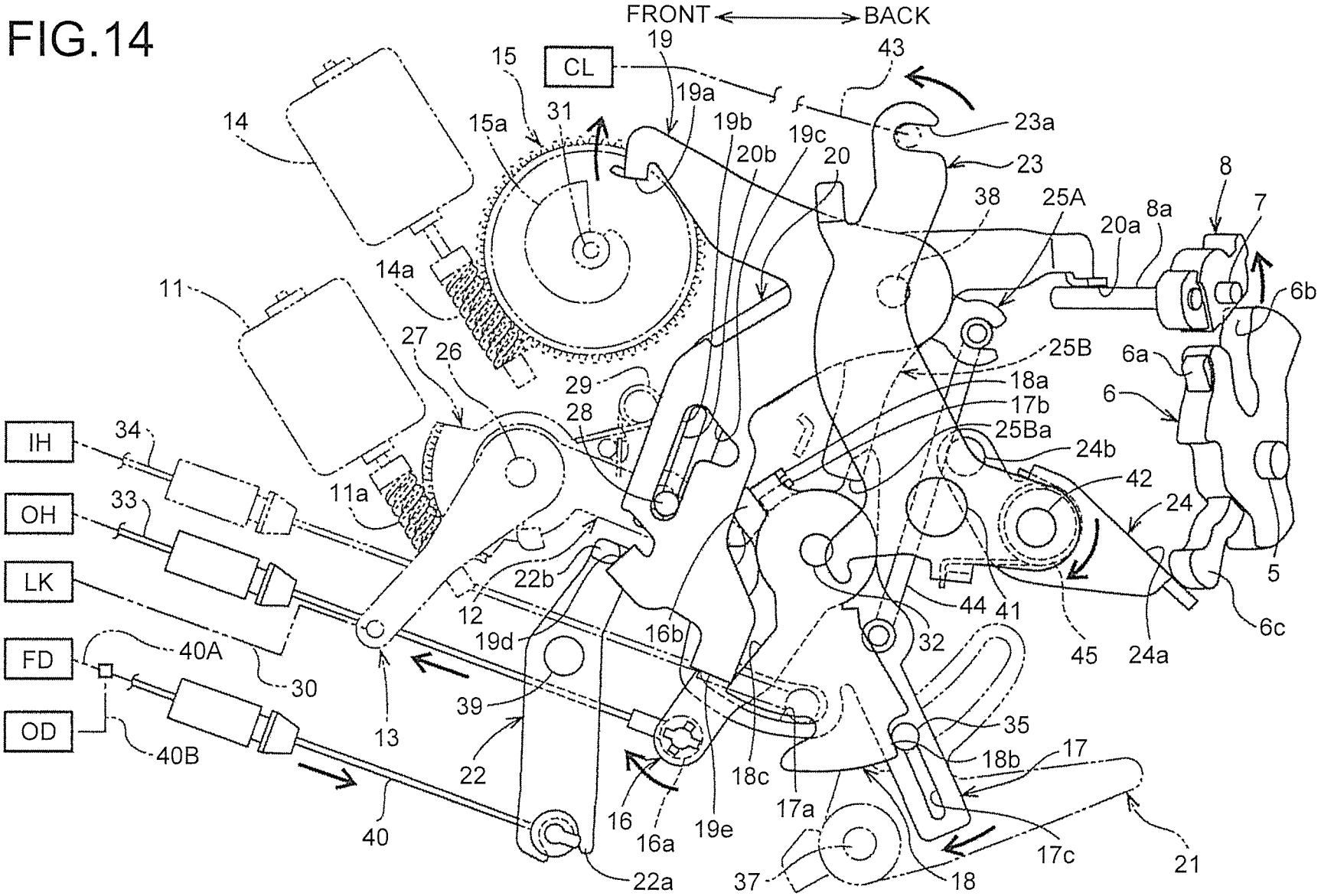
FIG. 14 is an actuation illustration in which cancel actuation is performed during the close actuation of the closer device.
Figure 15:
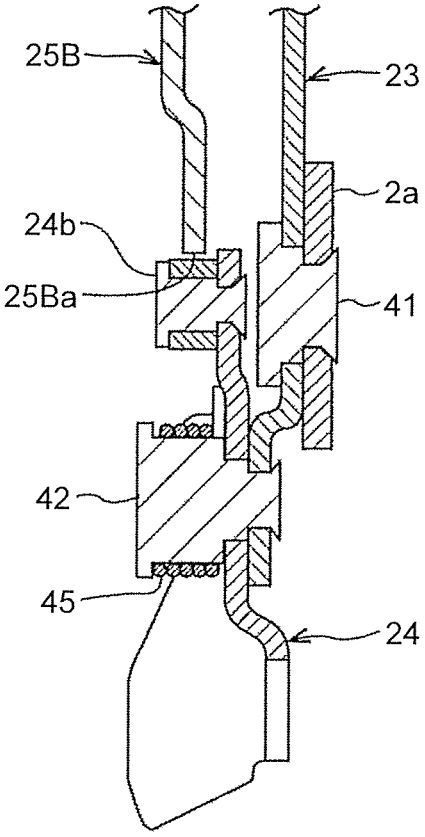
FIG. 15 is an enlarged cross-sectional view taken along line XV-XV in FIG. 7.

The second closer cancel lever 25B performs cancel actuation (pivotal movement clockwise in FIG. 7) around the pivot 38 from the initial position illustrated in FIG. 7 to pivot to the cancel position illustrated in FIG. 14, in conjunction with the cancel actuation of the first closer cancel lever 25A. A stopper 25Ba is provided at the tip end of an arm extending downward of the second closer cancel lever 25B.

When the second closer cancel lever 25B is in the initial position, the stopper 25Ba stops within the orbit of the virtual shaft 24*b* by pivotal movement of the second closer lever 24, that is, at the position (hereinafter referred to as "stopper position") where it can abut on the outer periphery of the virtual shaft 24*b* so as to prevent the pivotal movement in the clockwise direction around the joint shaft 42 of the second closer lever 24. When the second closer cancel lever 25B performs cancel actuation, the stopper 25Ba retreats to the outside of the orbit of the virtual shaft 24*b* to set free the pivotal movement in the clockwise direction about the joint shaft 42 of the second closer lever 24.

As described above, when each of the first closer cancel lever 25A and the second closer cancel lever 25B is in the initial position and the stopper 25Ba of the second closer cancel lever 25B is at the stopper position, the close actuation of the first closer lever 23 from the initial position by power of the closer device CL allows the second closer lever 24 to perform close actuation around the pivot 41 together with the first closer lever 23, and this actuation allows the output portion 24*a* to push up the arm 6*c* of the latch 6 in the half latch position from below, whereby the latch 6 is forced to pivot from the half latch position to the full latch position.

However, when each of the first closer cancel lever 25A and the second closer cancel lever 25B performs cancel actuation in the middle of close actuation of the first closer lever 23 and the second closer lever 24 by power of the closer device CL, the stopper 25Ba moves to the retreat position and sets free the pivotal movement in the clockwise direction around the joint shaft 42 of the second closer lever 24, so that the second closer lever 24 in abutment with the arm 6*c* of the latch 6 pivots clockwise against the biasing force of the spring 45 to disable transmission of the close actuation of the first closer lever 23 to the latch 6. With this configuration, even when the latch 6 is in the middle of forcedly pivoting toward the full latch position, the transmission path by power of the closer device CL can be cut off to disable transmission of power of the closer device CL.

The effect in each state of the automobile door latch device 1 in the present embodiment will now be described.

(A) Operation of Outside Handle OH (when the Locking/Unlocking Mechanism is in the Unlocked State and the Child-Proof Mechanism is in the Unlocked State or the Locked State)

Figure 8:
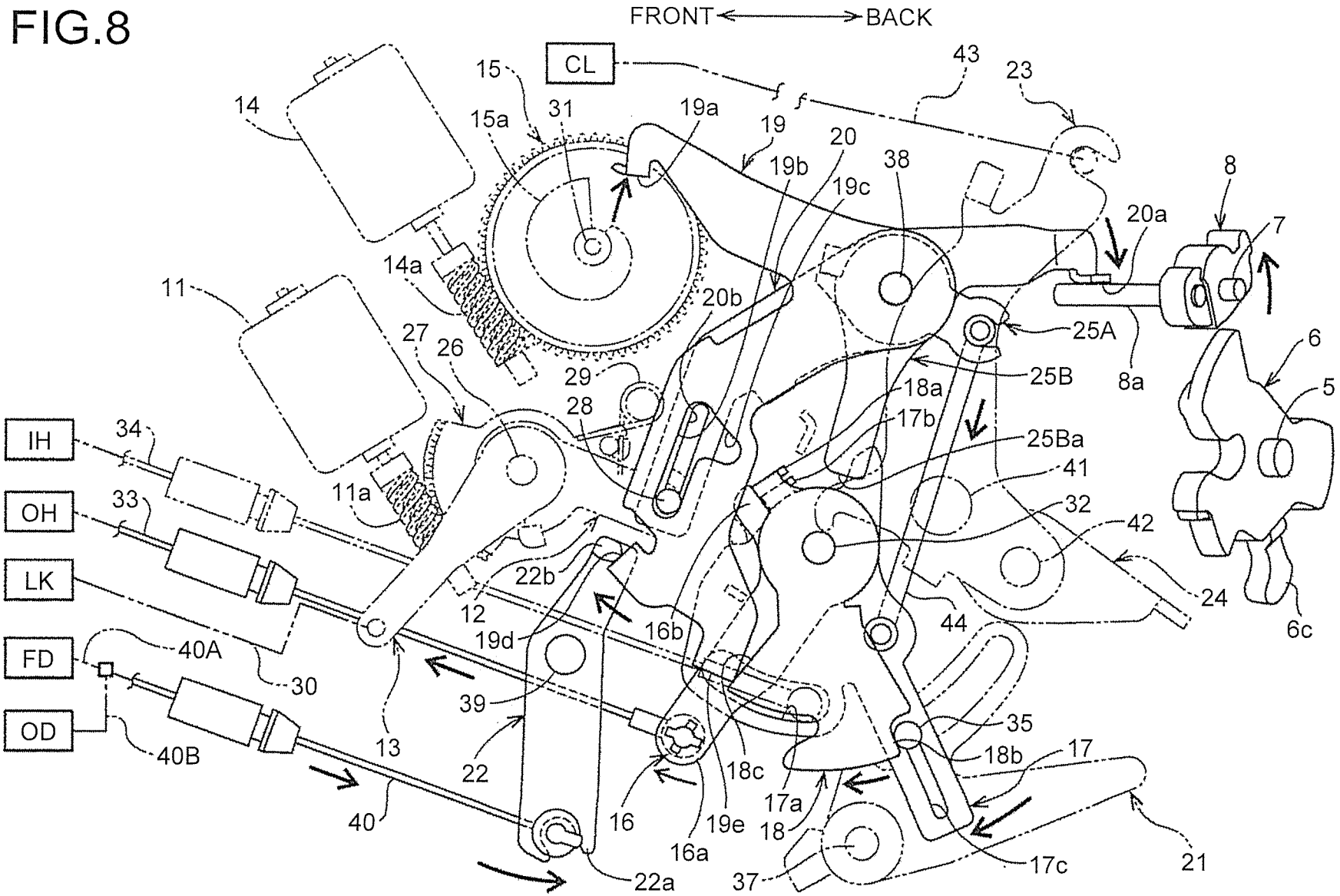
FIG. 8 is an actuation illustration in which an outside handle is operated with a locking/unlocking mechanism in the unlocked state.

A description is provided with reference to FIG. 8. The operating force of the outside handle OH is input to the input portion 16*a* of the outside lever 16 through the operating force transmission member 33. As illustrated in FIG. 8, the outside lever 16 performs open actuation around the pivot 32 from the initial position illustrated in FIG. 7. The open actuation of the outside lever 16 is transmitted to each of the first inside lever 17 and the second inside lever 18 as the output portion 16*b* abuts on the input portion 17*b* of the first inside lever 17 and the first input portion 18*a* of the second inside lever 18. Each of the first inside lever 17 and the second inside lever 18 thus performs open actuation.

The open actuation of the first inside lever 17 is transmitted to the first closer cancel lever 25A through the joint rod 44. Then, the first closer cancel lever 25A performs open actuation as illustrated in FIG. 8 from the initial position illustrated in FIG. 7, and this actuation allows the second closer cancel lever 25B to perform cancel actuation from the initial position as well. When the second closer cancel lever 25B performs cancel actuation, the stopper 25Ba moves to the retreat position.

The open actuation of the second inside lever 18 is transmitted to the first open lever 19 as the output portion 18*c* abuts on the input portion 19*e* of the first open lever 19. Then, the first open lever 19 performs open actuation as illustrated in FIG. 8 from the initial position. The open actuation of the first open lever 19 is transmitted to the second open lever 20 through the first lock pin 28 and transmitted to the fully open release lever 22 through the output portion 19*d*. Each of the second open lever 20 and the fully open release lever 22 thus performs open actuation as illustrated in FIG. 8 from the initial position.

Figures 16A, 16B, 16C:
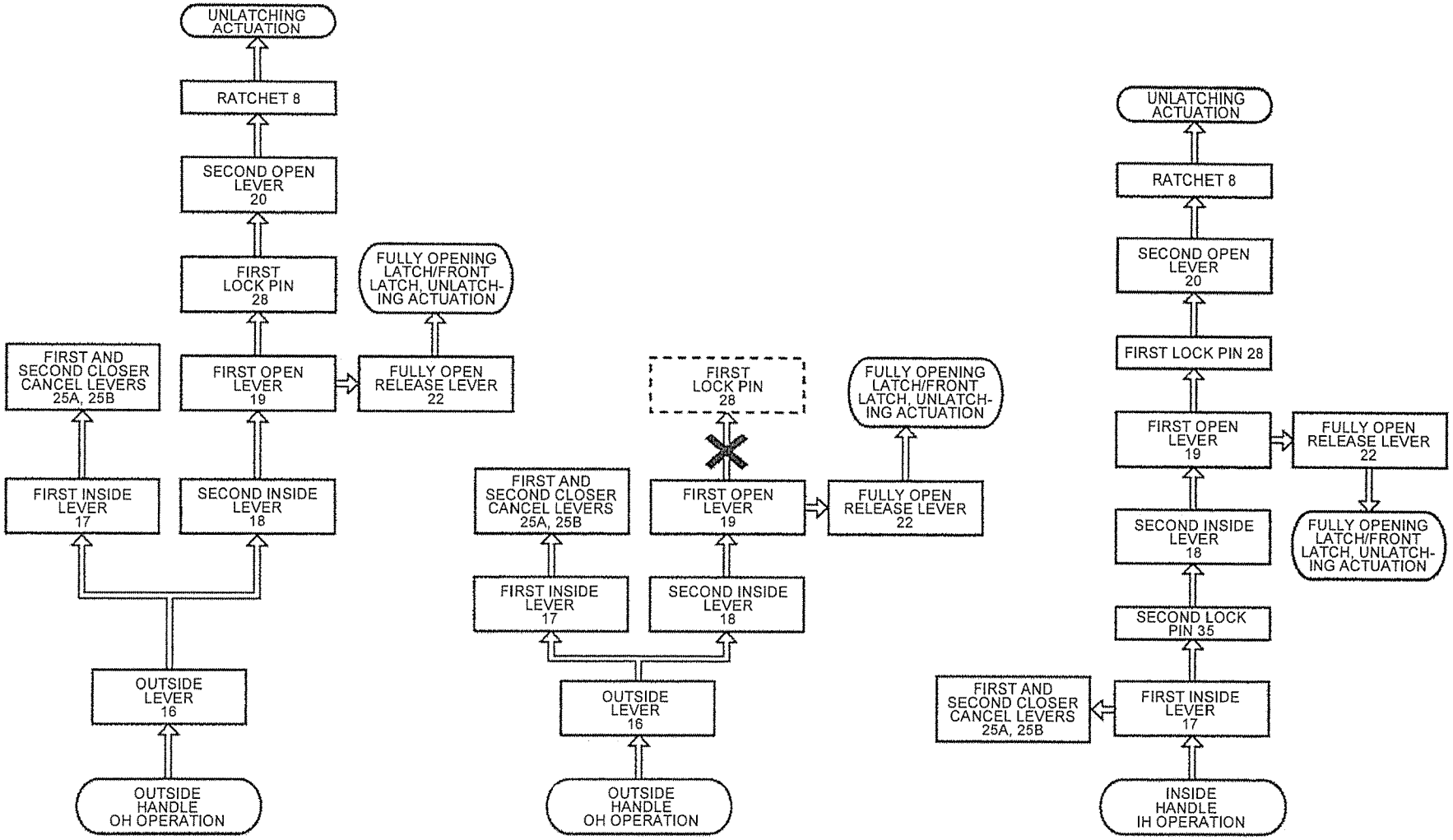
FIG. 16A is a chart illustrating an actuation transmission path when the outside handle is operated with the locking/unlocking mechanism in the unlocked state.
FIG. 16B is a chart illustrating an actuation transmission path when the outside handle is operated with the locking/unlocking mechanism in the locked state.
FIG. 16C is a chart illustrating an actuation transmission path when the inside handle is operated with the child-proof mechanism and the locking/unlocking mechanism in the unlocked state.

The above operating force actuation path in the outside handle OH is described with reference to FIG. 16A. The operating force of the outside handle OH is transmitted from the outside lever 16 to the first closer cancel lever 25A and the second closer cancel lever 25B via the first inside lever 17, also transmitted from the outside lever 16 to the ratchet 8 via the second inside lever 18, the first open lever 19, the first lock pin 28, and the second open lever 20, and further transmitted from the first open lever 19 to the fully opening latch unit OD and the front door latch device FD via the fully open release lever 22 and the operating force transmission member 40.

Accordingly, in the state illustrated in FIG. 8, based on the operation of the outside handle OH, if the slide door D is in the closed state, the automobile door latch device 1 and the front door latch device FD are allowed to perform unlatching actuation to enable the opening operation of the slide door D, whereas if the slide door D is in the fully open state, the fully opening latch unit OD is allowed to perform unlatching actuation to enable the closing operation of the slide door D.

(B) Operation of Outside Handle OH (when the Locking/Unlocking Mechanism is in the Locked State and the Child-Proof Mechanism is in the Unlocked State or the Locked State)

A description is provided with reference to FIG. 9. The operating force of the outside handle OH is input to the input portion 16*a* of the outside lever 16 through the operating force transmission member 33. As illustrated in FIG. 9, the outside lever 16 performs open actuation around the pivot 32 from the initial position illustrated in FIG. 7. The open actuation of the outside lever 16 is transmitted to each of the first inside lever 17 and the second inside lever 18 as the output portion 16*b* abuts on the input portion 17*b* of the first inside lever 17 and the first input portion 18*a* of the second inside lever 18. Each of the first inside lever 17 and the second inside lever 18 thus performs open actuation.

The open actuation of the first inside lever 17 is transmitted to the first closer cancel lever 25A through the joint rod 44. The first closer cancel lever 25A and the second closer cancel lever 25B thus perform cancel actuation as illustrated in FIG. 9 from the initial position illustrated in FIG. 7.

The open actuation of the second inside lever 18 is transmitted to the first open lever 19 as the output portion 18*c* abuts on the input portion 19*e* of the first open lever 19. Then, the first open lever 19 performs open actuation as illustrated in FIG. 9 from the initial position. The open actuation is transmitted to the fully open release lever 22 through the output portion 19*d* but not transmitted to the second open lever 20 since the first lock pin 28 is in the locked position.

Accordingly, in the state illustrated in FIG. 9, the operating force of the outside handle OH is transmitted to the fully opening latch unit OD and the front door latch device FD but not transmitted to the ratchet 8.

The above operating force actuation path is described with reference to FIG. 16B. The operating force of the outside handle OH is transmitted from the outside lever 16 to the first closer cancel lever 25A and the second closer cancel lever 25B via the first inside lever 17 and further transmitted from the outside lever 16 to the fully opening latch unit OD and the front door latch device FD via the second inside lever 18, the first open lever 19, the fully open release lever 22, and the operating force transmission member 40 but not transmitted from the first open lever 19 to the first lock pin 28.

Accordingly, in the state illustrated in FIG. 9, based on the operation of the outside handle OH, if the slide door D is in the closed state, the opening operation of the slide door D is disabled, whereas if the slide door D is in the fully open state, the fully opening latch unit OD is allowed to perform unlatching actuation to enable the closing operation of the slide door D.

(C) Operation of Inside Handle IH (when the Locking/Unlocking Mechanism is in the Unlocked State and the Child-Proof Mechanism is in the Unlocked State)

Figure 10:
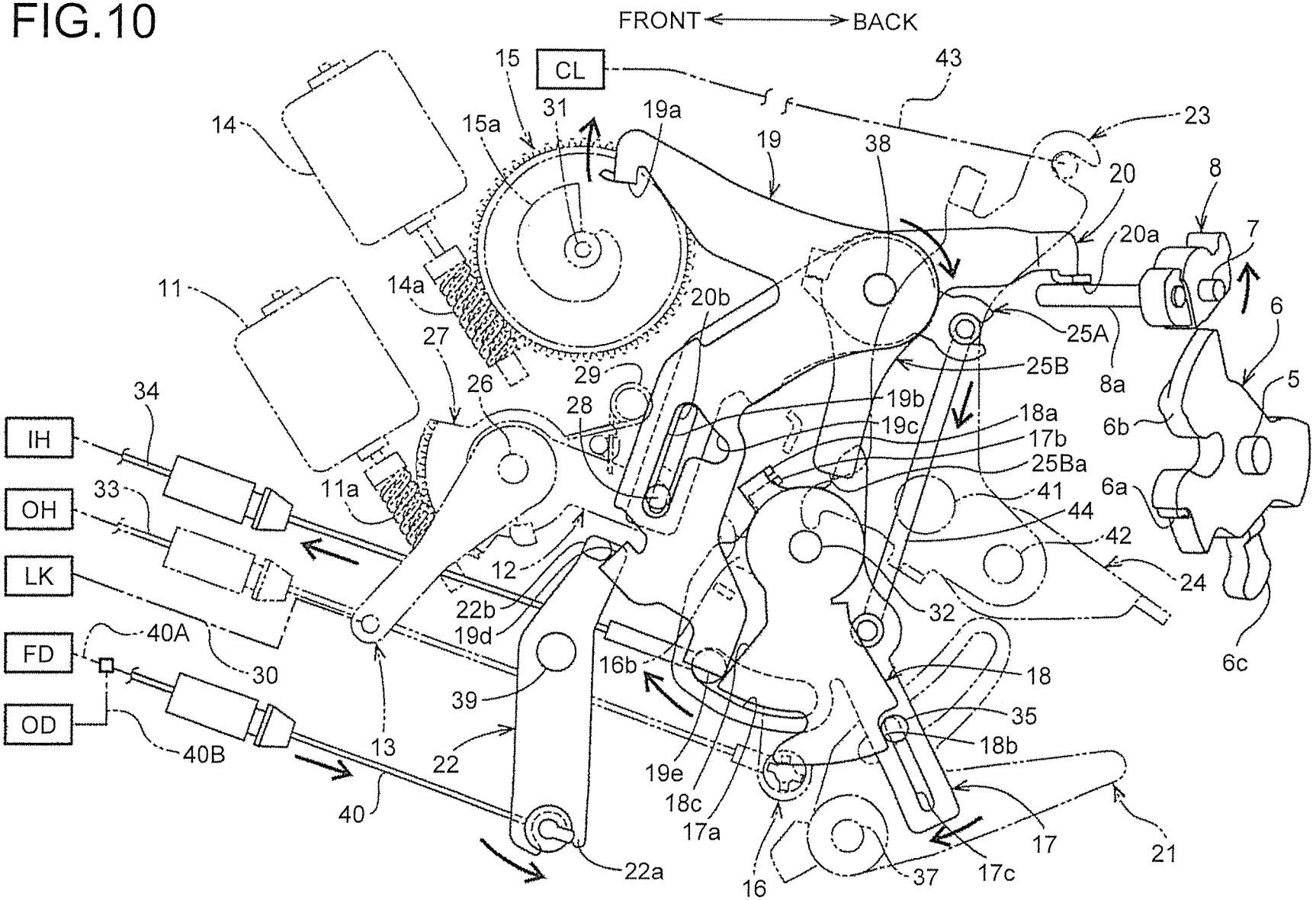
FIG. 10 is an actuation illustration in which an inside handle is operated with a child-proof mechanism in the unlocked state.

A description is provided based on FIG. 10. The operating force of the inside handle IH is input to the first inside lever 17 through the elongated hole 17*a* of the first inside lever 17 through the operating force transmission member 34. As illustrated in FIG. 10, the first inside lever 17 performs open actuation around the pivot 32 from the initial position. The open actuation of the first inside lever 17 is transmitted to the first closer cancel lever 25A and the second closer cancel lever 25B through the joint rod 44 and to the second inside lever 18 through the second lock pin 35.

The open actuation of the second inside lever 18 is transmitted to the first open lever 19 as the output portion 18*c* abuts on the input portion 19*e* of the first open lever 19. Then, the first open lever 19 performs open actuation as illustrated in FIG. 10 from the initial position. The open actuation of the first open lever 19 is transmitted to the second open lever 20 through the first lock pin 28 and to the fully open release lever 22 through the output portion 19*d*. Each of the second open lever 20 and the fully open release lever 22 then performs open actuation as illustrated in FIG. 10 from the initial position, and this actuation is transmitted to each of the ratchet 8, the fully opening latch unit OD, and the front door latch device FD.

The above operating force actuation path is described with reference to FIG. 16C. The operating force of the inside handle IH is transmitted to the ratchet 8 via the first inside lever 17, the second lock pin 35, the second inside lever 18, the first open lever 19, the first lock pin 28, and the second open lever 20 and also transmitted from the first open lever 19 to the fully opening latch unit OD and the front door latch device FD via the fully open release lever 22 and the operating force transmission member 40. Furthermore, the operating force is also transmitted from the first inside lever 17 to the first closer cancel lever 25A and the second closer cancel lever 25B via the joint rod 44.

Accordingly, in the state illustrated in FIG. 10, based on the operation of the inside handle IH, if the slide door D is in the closed state, the automobile door latch device 1 and the front door latch device FD are allowed to perform unlatching actuation to enable the opening operation of the slide door D, whereas if the slide door D is in the fully open state, the fully opening latch unit OD is allowed to perform unlatching actuation to enable the closing operation of the slide door D.

(D) Operation of Inside Handle IH (when the Locking/Unlocking Mechanism is in the Unlocked State or the Locked State and the Child-Proof Mechanism is in the Locked State)

A description is provided based on FIG. 11. The operating force of the inside handle IH is input to the first inside lever 17 through the elongated hole 17*a* of the first inside lever 17 through the operating force transmission member 34. As illustrated in FIG. 11, the first inside lever 17 performs open actuation around the pivot 32 from the initial position.

In this case, since each of the child-proof lever 21 and the second lock pin 35 is in the locked position, the open actuation of the first inside lever 17 is not transmitted to the second inside lever 18 but is transmitted to the first closer cancel lever 25A and the second closer cancel lever 25B via the joint rod 44.

The above operating force actuation path is described with reference to FIG. 17A. The operating force of the inside handle IH is transmitted to the first closer cancel lever 25A and the second closer cancel lever 25B via the first inside lever 17 but not transmitted to the other elements.

Accordingly, in the state illustrated in FIG. 11, even when the inside handle IH is operated, the slide door D in the closed position will not open and the slide door D in the fully open position will not close, either, but the cancel actuation of the second closer cancel lever 25B is enabled. By doing so, even when the child-proof mechanism is in the locked state, the close actuation of the closer device CL can be canceled by operating the inside handle IH. The above actuation is the same whether the locking/unlocking mechanism is in the unlocked state or in the locked state.

(E) Operation of Inside Handle IH (when the Locking/Unlocking Mechanism is in the Locked State and the Child-Proof Mechanism is in the Unlocked State)

The operating force of the inside handle IH is input to the first inside lever 17 through the elongated hole 17*a* of the first inside lever 17 through the operating force transmission member 34. The first inside lever 17 performs open actuation around the pivot 32 from the initial position. The open actuation of the first inside lever 17 is transmitted to the first closer cancel lever 25A and the second closer cancel lever 25B through the joint rod 44 and to the second inside lever 18 through the second lock pin 35. The second cancel lever 25B then performs cancel actuation, and the second inside lever 18 performs open actuation.

The open actuation of the second inside lever 18 is transmitted to the first open lever 19 as the output portion 18*c* abuts on the input portion 19*e* of the first open lever 19. Then, the first open lever 19 performs open actuation from the initial position and thereby transmits the open actuation to the fully open release lever 22 through the output portion 19*d* but does not transmit the open actuation to the second open lever 20 since the first lock pin 28 is in the locked position.

The above operating force actuation path is described with reference to FIG. 17B. The operating force of the inside handle IH is transmitted to the fully open release lever 22 via the first inside lever 17, the second lock pin 35, the second inside lever 18, and the first open lever 19. However, since the first lock pin 28 is in the locked position, the open actuation of the first open lever 19 is not transmitted to the first lock pin 28. The open actuation is transmitted from the first inside lever 17 to the first closer cancel lever 25A and the second closer cancel lever 25B through the joint rod 44.

Accordingly, in the state above, the slide door D in the closed position will not open based on the operation of the inside handle IH, but the slide door D in the fully open position can be closed. Since the cancel actuation of the second closer cancel lever 25B is enabled, the close operation of the closer device CL can also be canceled by operating the inside handle IH.

(F) Electrically Powered Operation by Opening Motor 14 (when the Locking/Unlocking Mechanism is in the Unlocked State and the Child-Proof Mechanism is in the Unlocked State)

Figure 12:
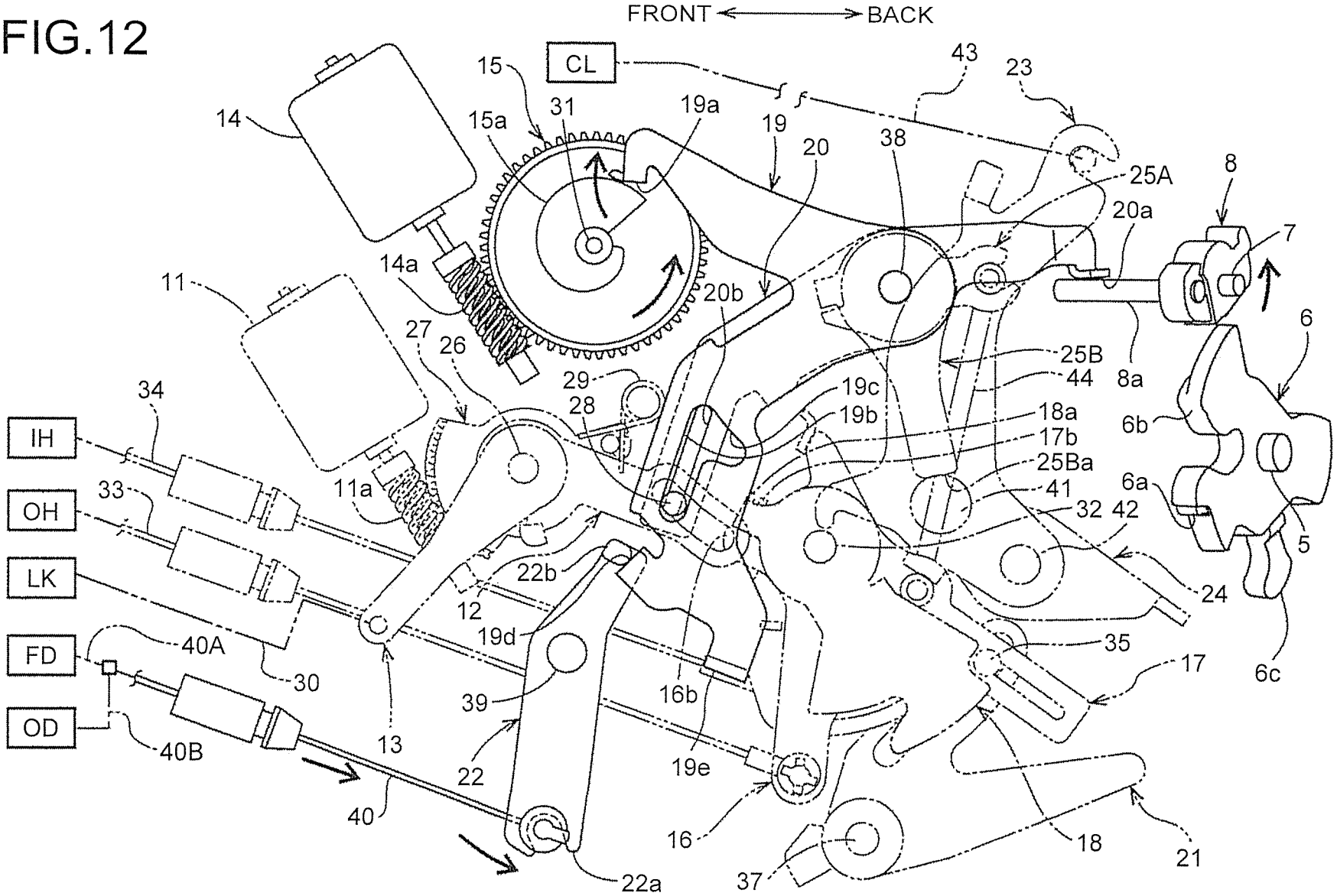
FIG. 12 is an actuation illustration in which an opening motor performs open actuation.

A description is provided based on FIG. 12. For example, when the opening motor 14 is driven based on operation of the wireless operation switch, the opening rotor 15 meshed with the worm 14*a* rotates counterclockwise from the initial position. The first open lever 19 in slidable contact with the cam 15*a* performs open actuation in accordance with rotation of the cam 15*a*.

The open actuation of the first open lever 19 is transmitted to the ratchet 8 via the first lock pin 28 and the second open lever 20 and also transmitted to each of the fully opening latch unit OD and the front door latch device FD via the output portion 19*d*, the fully open release lever 22, and the operating force transmission member 40.

Figure 17C:
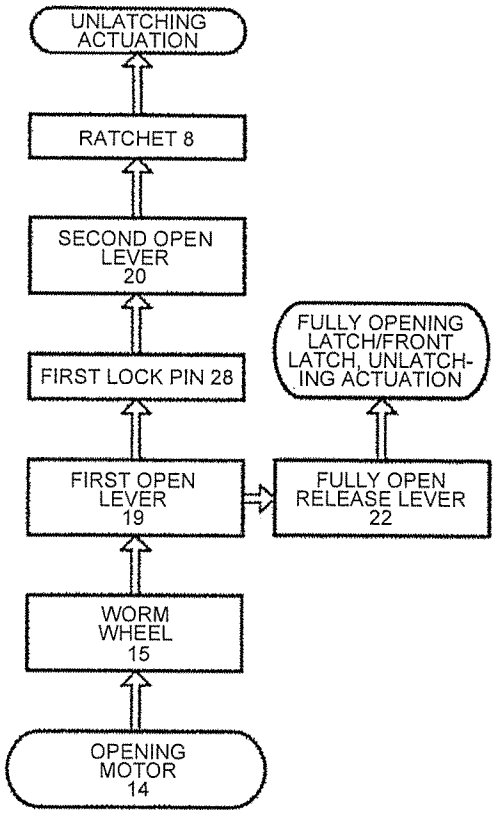
FIG. 17C is a chart illustrating an actuation transmission path when the opening motor is driven with the locking/unlocking mechanism in the unlocked state.
Figure 17B:
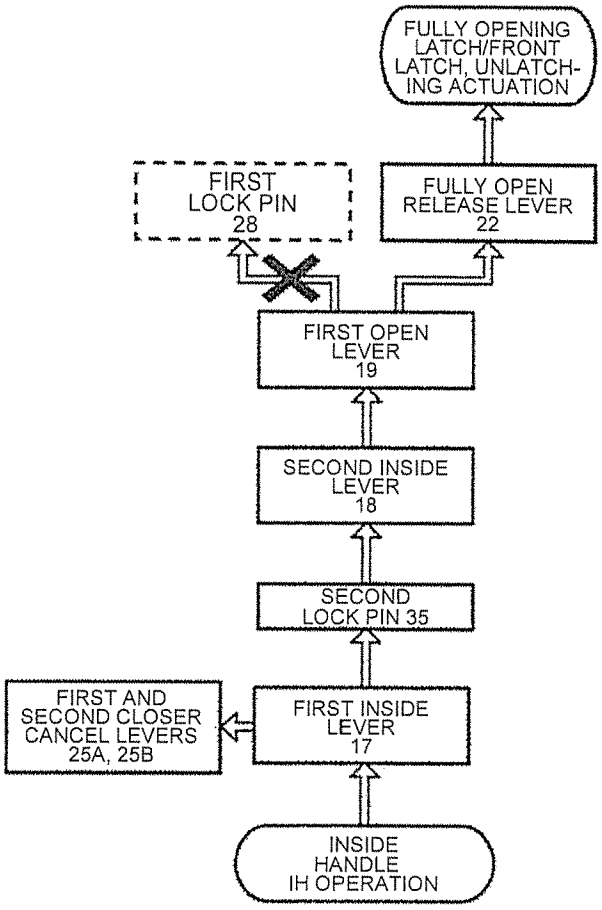
FIG. 17B is a chart illustrating an actuation transmission path when the inside handle is operated with the locking/unlocking mechanism in the locked state and the child-proof mechanism in the unlocked state.
Figure 17A:
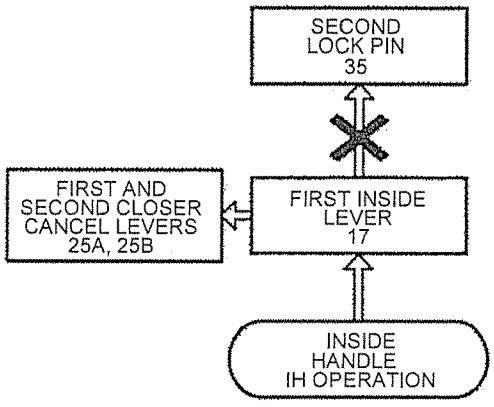
FIG. 17A is a chart illustrating an actuation transmission path when the inside handle is operated with the child-proof mechanism in the locked state.

The above operating force actuation path is as illustrated in FIG. 17C.

Accordingly, in the state illustrated in FIG. 12, based on power of the opening motor 14, if the slide door D is in the closed state, the automobile door latch device 1 and the front door latch device FD are allowed to perform unlatching actuation to enable the opening operation of the slide door D, whereas if the slide door D is in the fully open state, the fully opening latch unit OD is allowed to perform unlatching actuation to enable the closing operation of the slide door D.

In the case where the wireless operation switch is operated when the slide door D is in the closed state and the locking/unlocking mechanism is in the locked state, first, the locking/unlocking motor 11 is driven and controlled such that each of the lock lever 12, the first lock pin 28, and the knob lever 13 is moved from the locked position to the unlocked position to set the locking/unlocking mechanism to the unlocked state, and thereafter the opening motor 14 is driven and controlled. By doing so, in the operation of the wireless operation switch, even when the locking/unlocking mechanism is in the locked state, the slide door D can be opened by a single operation.

The actuation of power in the opening motor 14 is not transmitted to the first inside lever 17 and the second inside lever 18 which are elements related to the child-proof mechanism. Thus, the actuation path of power by the opening motor 14 is always the path as described above, irrespective of the state of the child-proof mechanism.

(G) Close Actuation by Closer Device CL

Figure 13:
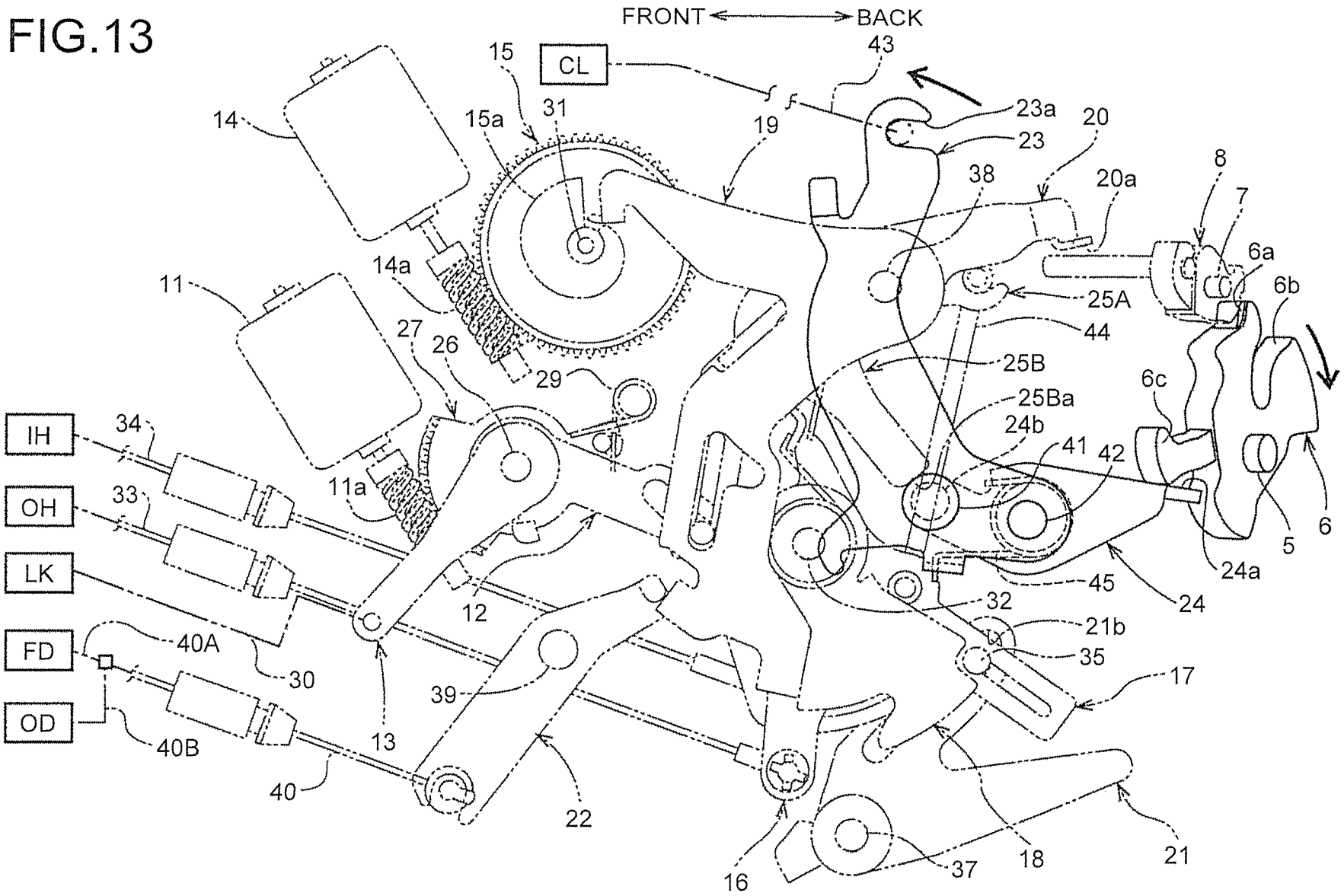
FIG. 13 is an actuation illustration in which a closer device performs close actuation.

A description is provided with reference to FIG. 13. When the latch 6 pivots from the open position to the half latch position (the position where the arm 6*c* of the latch 6 is located below the position illustrated in FIG. 13) in accordance with the closing operation of the slide door D, the pivotal movement is detected by a not-illustrated detection switch. In response to the detection, the closer device CL is driven and controlled by a not-illustrated control circuit device, and its power is transmitted to the first closer lever 23 through the operating force transmission member 43. Then, the first closer lever 23 performs close actuation around the pivot 41 from the initial position. In this case, since the second closer cancel lever 25B is in the initial position and its stopper 25Ba is in the stopper position where it can abut on the virtual shaft 24*b* of the second closer lever 24, the second closer lever 24 performs close actuation substantially integrally with the first closer lever 23, and the output portion 24*a* moves upward in accordance with this actuation and thereby comes into abutment with the arm 6*c* of the latch 6 from below to force the latch 6 to pivot from the half latch position to the full latch position. Then, after the pivotal movement of the latch 6 to the full latch position causes the slide door D to be fully closed, the closer device CL is reversely controlled so that the first closer lever 23 and the second closer lever 24 return to the initial position.

The above actuation path is described with reference to FIG. 18A. The power of the closer device CL is transmitted to the latch 6 via the operating force transmission member 43, the first closer lever 23, and the second closer lever 24.

(H) Cancel Actuation of Close Actuation by Closer Device CL

For example, when something is caught between the slide door D and the deck in the middle of actuation of the closer device CL described in (G) above and the close actuation has to be canceled urgently, the close actuation can be canceled by operating the outside handle OH or the inside handle IH.

The cancel actuation of the close actuation is described with reference to FIGS. 13 and 14. FIG. 14 illustrates a state when the outside handle OH is operated.

If the outside handle OH or the inside handle IH is operated in the middle of close actuation of the first closer lever 23 and the second closer lever 24 by power of the closer device CL or immediately before close actuation, the open actuation of the first inside lever 17 is transmitted to the first closer cancel lever 25A and the second closer cancel lever 25B through the joint rod 44 as described above. Then, the second closer cancel lever 25B performs cancel actuation, and the stopper 25Ba moves to the retreat position where it is unable to abut on the virtual shaft 24*b* of the second closer lever 24.

When the second closer cancel lever 25B performs cancel actuation, the second closer lever 24 is set free to pivot clockwise around the joint shaft 42. Then, the close actuation of the second closer lever 24, which has abutted on the arm 6*c* of the latch 6 to allow the latch 6 to pivot toward the full latch position, becomes unable to be transmitted to the latch 6, and the close actuation of the closer device CL is cut off between the second closer lever 24 and the latch 6. At the same time, the second open lever 20 performs open actuation, and the open actuation of the second open lever 20 allows the ratchet 8 to perform open actuation, so that the pivotal movement of the latch 6 to the open position is set free. As a result, the slide door D can be promptly opened to avoid the danger of being caught.

Figure 18B:
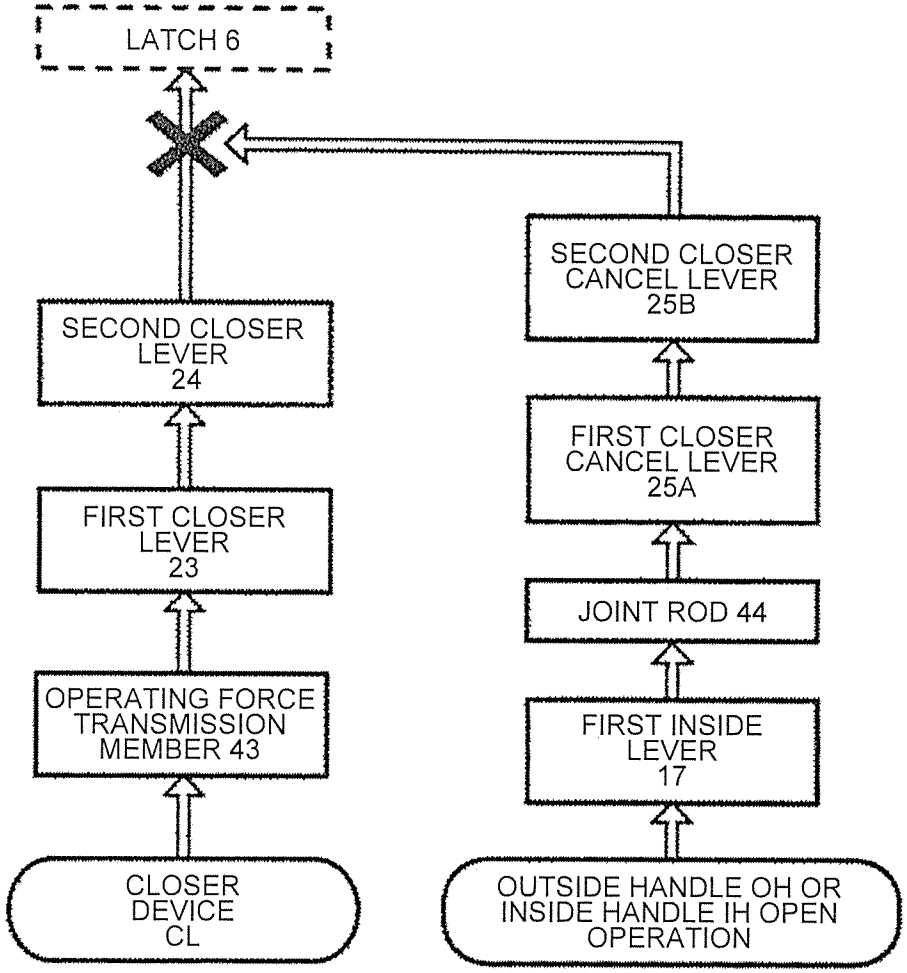
FIG. 18B is a chart illustrating cancel actuation of the close actuation.
Figure 18A:
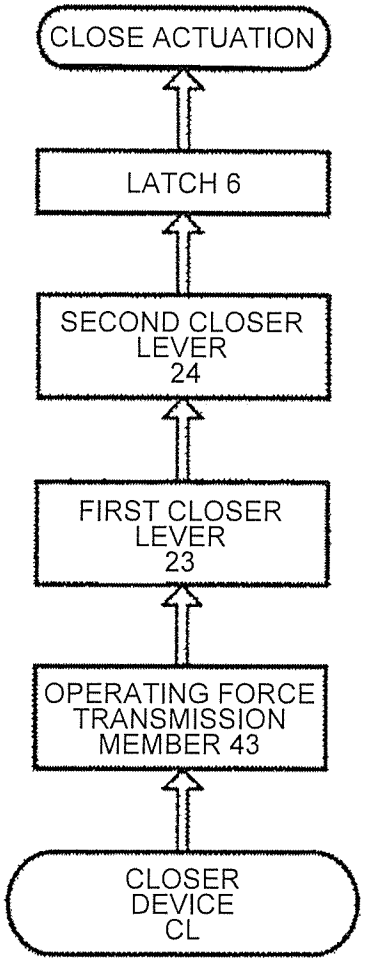
FIG. 18A is a chart illustrating an actuation transmission path of closer actuation.

The above actuation path is as illustrated in FIG. 18B. Specifically, the close actuation of the closer device CL is transmitted to the second closer lever 24 via the operating force transmission member 43 and the first closer lever 23, but the transmission path between the second closer lever 24 and the latch 6 is cut off when the outside handle OH or the inside handle IH is operated.

The cancel actuation of the close actuation described above is achieved by allowing the second closer cancel lever 25B to perform cancel actuation by the open actuation of the first inside lever 17 normally in conjunction with the operation of the outside handle OH and the inside handle IH and therefore can be performed by operating the outside handle OH and the inside handle IH irrespective of the state of the locking/unlocking mechanism and the child-proof mechanism.

As described above, the automobile door latch device 1 in the present embodiment includes the latch mechanism and the arrangement in which the outside lever 16 receiving the operation of the outside handle OH to perform open actuation, the first open lever 19 interlocked with the open actuation of the outside lever 16, the locking/unlocking mechanism (the lock lever 12 and the first lock pin 28) switchable between the unlocked state to enable output of the open actuation of the first open lever 19 and the locked state to disable the output, the second open lever 20 interlocked with the open actuation of the first open lever 19 output from the locking/unlocking mechanism to allow the ratchet 8 to perform unlatching actuation, and the fully open release lever 22 interlocked with the open actuation of the first open lever 19 are collectively arranged on the base. This configuration enables the open actuation of the fully open release lever 22 arranged on the base to be directly transmitted to the fully opening latch unit OD through the single operating force transmission member 40, thereby reducing the number of operating force transmission members. This alleviates the work of connecting the operating force transmission members and the work of attaching the units.

According to the present disclosure, the outside lever receiving the operating force of the outside handle, the first open lever interlocked with the open actuation of the outside lever, the locking/unlocking mechanism switchable between the unlocked state and the locked state, the second open lever interlocked with the open actuation of the first open lever output from the locking/unlocking mechanism to allow the ratchet to perform unlatching actuation, and the fully open release lever interlocked with the open actuation of the first open lever are collectively arranged on the base directly or indirectly fixed to the body accommodating the mesh mechanism. This configuration can improve the efficiency of attachment work on the slide door and reduce the number of operating force transmission members.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An automobile door latch device comprising:

a mesh mechanism including:

a latch configured to mesh with a striker to hold a slide door in a closed position; and a ratchet configured to engage with the latch;

a body configured to accommodate the mesh mechanism;

a base fixed to the body, the base including:

an operation mechanism arrangement part formed integrally with a cover plate fixed to the body; and a base plate directly or indirectly fixed to the body; and an operation mechanism disposed on the base, the operation mechanism including:

an outside lever pivotably supported on the base, and configured to receive an operating force of an outside handle disposed at the slide door to perform open actuation;

a first open lever pivotably supported on the base, and configured to perform open actuation in conjunction with open actuation of the outside lever;

a locking/unlocking mechanism supported on the base, and configured to be switchable between an unlocked state to enable output of open actuation of the first open lever and a locked state to disable the output of open actuation of the first open lever;

a second open lever pivotably supported on the base, and configured to perform open actuation in conjunction with open actuation of the first open lever output from the locking/unlocking mechanism and allow the ratchet to perform unlatching actuation through the open actuation; and a fully open release lever pivotably supported on the base, and configured to perform open actuation in conjunction with open actuation of the first open lever, the fully open release lever being connected to an operating force transmission member configured to transmit the open actuation of the fully open release lever to a fully opening latch device for holding the slide door in a fully open position wherein the operation mechanism is collectively arranged between the operation mechanism arrangement part and the base plate.

2. The automobile door latch device according to claim 1, wherein the operation mechanism further includes:

a first inside lever pivotably supported on the base, and configured to receive operation of an inside handle disposed at the slide door to perform open actuation;

a child-proof mechanism supported on the base, and configured to be switchable between an unlocked state to enable output of open actuation of the first inside lever and a locked state to disable the output of open actuation of the first inside lever; and a second inside lever pivotably supported on the base, and configured to transmit open actuation of the first inside lever output from the child-proof mechanism to the first open lever, and when the child-proof mechanism is in a locked state, the fully open release lever does not perform open actuation based on operation of the inside handle.

3. The automobile door latch device according to claim 1, wherein the operation mechanism further includes:

an opening motor disposed on the base; and an opening rotor pivotably supported on the base, and configured to be pivotable by the opening motor, and the opening rotor is pivoted by the opening motor to allow the fully open release lever to perform open actuation through the first open lever.

4. The automobile door latch device according to claim 2, wherein the operation mechanism further includes:

an opening motor disposed on the base; and an opening rotor pivotably supported on the base, and configured to be pivotable by the opening motor, and the opening rotor is pivoted by the opening motor to allow the fully open release lever to perform open actuation through the first open lever.

5. The automobile door latch device according to claim 1, wherein the operation mechanism further includes:

a first closer lever pivotably supported on the operation mechanism arrangement part, and configured to perform close actuation in conjunction with pivoting of an output lever of a closer device in a predetermined direction; and a second closer lever pivotably connected to the first closer lever.

6. The automobile door latch device according to claim 1, wherein the base plate is directly or indirectly fixed to the body and the cover plate, and disposed in parallel with the operation mechanism arrangement part.

7. The automobile door latch device according to claim 1, wherein the outside lever, the first open lever, the locking/unlocking mechanism, the second open lever and the fully open release lever are pivotably supported on the base plate.

* * * * *